US012035752B2

(12) United States Patent
Trzecieski

(10) Patent No.: US 12,035,752 B2
(45) Date of Patent: Jul. 16, 2024

(54) WATER FILTRATION APPARATUS

(71) Applicant: GS Holistic, LLC, Los Angeles, CA (US)

(72) Inventor: Michael Trzecieski, Parry Sound (CA)

(73) Assignee: GS HOLISTIC, LLC, Saint Louis, MO (US)

( * ) Notice: Subject to any disclaimer, the term of this patent is extended or adjusted under 35 U.S.C. 154(b) by 342 days.

(21) Appl. No.: 17/207,825

(22) Filed: Mar. 22, 2021

(65) Prior Publication Data

US 2021/0289843 A1 Sep. 23, 2021

Related U.S. Application Data

(60) Provisional application No. 62/993,000, filed on Mar. 22, 2020.

(51) Int. Cl.
*A24F 40/48* (2020.01)
*A24F 1/14* (2006.01)
(Continued)

(52) U.S. Cl.
CPC ..... *A24F 40/48* (2020.01); *A24F 1/14* (2013.01); *A24F 1/30* (2013.01); *A24F 40/85* (2020.01)

(58) Field of Classification Search
CPC ..... A24F 00/00; A24F 40/40; A24F 40/48; A24F 40/85; A24F 1/02; A24F 1/04; A24F 1/06; A24F 1/14
See application file for complete search history.

(56) References Cited

U.S. PATENT DOCUMENTS 4,140,138 A 2/1979 Keller
5,062,824 A * 11/1991 Prokopius ..... F16H 1/46 475/342

(Continued)

OTHER PUBLICATIONS

Reddit post entitled "Battery powered acrylic LED cube bong" 5 pages, posted Aug. 4, 2018 by user "Thesaturndude". Retrieved from the Internet: https://www.reddit.com/r/StonerEngineering/comments/94i7db/battery_powered_acrylic_led_cube_bong/ (Year: 2019).*

(Continued)

*Primary Examiner* — Christopher M Rodd
*Assistant Examiner* — Daniel Edward Vakili
(74) *Attorney, Agent, or Firm* — Kevin Schraven; Anooj Patel; Hankin Patent Law, APC

(57) ABSTRACT

A novel water filtration apparatus is disclosed having a downstem assembly from which a combustion aerosol or an aerosol is generated. The water filtration apparatus including a rotatable water filtration assembly rotatably mounted about a fixed shaft member and including two chambers generally separated by a divider wall having drain passage formed therein and wherein the rotatable water filtration assembly is normally oriented vertically with one chamber being disposed over the other and wherein said chamber is adapted to contain a volume of liquid that moves from one chamber to the other through the drain passage in response to rotating the rotatable water filtration assembly one-half turn. Routing of the aerosol through an upper disposed chamber and percolating the aerosol through the liquid and as the liquid within said chamber moves from the upper oriented chamber to the lower oriented chamber after each half turn, the falling liquid creating a vacuum space above the falling liquid in the upper chamber that draws air through the downstem assembly and the aerosol flowing and percolating into the upper disposed chamber while aerosol contained in the lower (Continued)

chamber is exhausted from said chamber via an exhaust opening towards a mouthpiece assembly.

15 Claims, 31 Drawing Sheets

(51) Int. Cl.
*A24F 1/30* (2006.01)
*A24F 40/85* (2020.01)

(56) References Cited

U.S. PATENT DOCUMENTS 10,342,255 B2 * 7/2019 Huston ..... A24F 1/30
D943,817 S * 2/2022 Rule
2021/0259305 A1 * 8/2021 Hagen ..... A24F 1/30
2022/0275819 A1 * 9/2022 Ziltener ..... F16B 7/04
2022/0330613 A1 * 10/2022 Emmet ..... A24F 40/46

OTHER PUBLICATIONS

Amazon post entitled "Remote control and waterproof!" 7 pages, posted May 8, 2019 by user "Wild Wild Wes". Retrieved from the internet: < https://www.amazon.com/Underwater-Submersible-Multicolor-Waterproof-Flameless/product-reviews/B07MYTZT48/ref=cm_cr_getr_d_paging_btm_next_7?ie=UTF8&reviewerType=all (Year: 2019).*
DIYPipes You Tube Post "How to: Make a Gravity Bong (Percolating)" 1 page, posted Jul. 6, 2011 by user "DIYPipes". Retrieved from the internet: <https://www.youtube.com/watch?v=t_2MfKLI-Tc>. (Year: 2011).*
Studenglass Product page: <https://caliconnected.com/products/studenglass-gravity-bong>, 10 pages, with a comment posted by Anonymous on Apr. 16, 2019. (Year: 2019).*

* cited by examiner

WATER FILTRATION APPARATUS

CROSS-REFERENCE TO RELATED APPLICATIONS

This application claims the benefit of U.S. Provisional Application No. 62/993,000 filed Mar. 22, 2020, the entirety of which is incorporated herein by reference.

FIELD OF THE INVENTION

This application relates generally to devices for water filtration of atomized phyto materials and their extracts.

INTRODUCTION

The following is intended to introduce the reader to the detailed description that follows and not to define or limit the claimed subject matter. There are smoking apparatus known in the art that gravity operated, such as disclosed by Keller, U.S. Pat. No. 4,140,138 and by Houston, U.S. Pat. No. 10,342,255. These smoking devices provide substantially unfiltered smoke to an end user through the use of gravitational flow of water.

It is therefore an object of the present invention to provide for a gravity operated water filtration device that overcomes the deficiencies of the prior art.

SUMMARY

The following introduction is provided to introduce the reader to the more detailed description to follow and not to limit or define any claimed or as yet unclaimed invention. One or more inventions may reside in any combination or sub-combination of the elements or process steps disclosed in any part of this document including its claims and figures.

In accordance with an aspect of this disclosure, there is provided a water filtration apparatus comprising: a downstem assembly; a fixed shaft member having a proximal end fluidly coupled with a downstem assembly and a distal end fluidly coupled with a mouthpiece assembly, such that in an operating process air may enter the downstem assembly and move through and into the fixed shaft member and into a shaft member first fluid pathway from the proximal end and into a shaft member second fluid pathway and out from the distal end, wherein the shaft member first fluid pathway and the shaft member second fluid pathway are other than fluidly coupled together within the fixed shaft member; a rotatable water filtration assembly rotatively mounted about said fixed shaft member for pulling air through the downstem assembly into the fixed shaft member first fluid pathway and for pushing air into the distal end of the fixed shaft member through the fixed shaft member second fluid pathway in response to the rotatable water filtration assembly being rotated about said fixed shaft member, wherein the rotatable water filtration assembly comprises: a first chamber adapted to contain a volume of liquid less than a total capacity of the first chamber; and, a second chamber adapted to contain the volume of liquid less than a total capacity of the second chamber and, a drain passage disposed between the first chamber and second chamber for allowing of liquid to drain therethrough under an influence of gravity, wherein in use as rotatable water filtration assembly is rotated about the fixed shaft member the volume of liquid after a revolution first assumes a generally top elevated position within one of the first chamber and second chamber and gravitates through the drain passage to the other of the first chamber and second chamber due to the influence of gravity, wherein the movement of the liquid from the top elevated position within the one of the first chamber and second chamber to the lower of the other of the first chamber and second chamber results in a suction area about an upper portion of the one of the first chamber and second chamber and this induces air to flow from the downstem assembly and through the first shaft member fluid pathway and results in the induced air flow to percolate upwardly through the volume of liquid downwardly draining through the drain passage and for the percolated air to gather into an upper area of the one of the first chamber and second chamber, wherein the downward movement of the liquid forces air disposed in the other of the first chamber and second chamber, that was received therein during the previous revolution of the rotatable water filtration assembly, through an exhaust opening fluidly connected with the fixed shaft member second fluid pathway, such that during each revolution of the rotatable water filtration assembly a volume of air is received within the one of the first chamber and second chamber and the previous volume of air received during the preceding revolution it exhausted from the other of the one of the first chamber and second chamber.

In some embodiments a stand assembly is provided for being coupled with the fixed shaft member and for supporting of the fixed shaft member and for orienting of the fixed shaft member with an orientation with respect to gravity, the stand assembly comprising: a stand collar for supporting the fixed shaft member; a stand arm having a first end coupled with the stand collar and a second end extending radially from the stand collar towards a base assembly transversely oriented with the stand arm.

In some embodiments the stand assembly comprises: a stand collar for supporting the fixed shaft member; at least a keyway formed within the stand collar and the fixed shaft member having a keyseat; a key disposed within the least a keyway and the keyseat, the key for preventing rotation of the fixed shaft member in relation to the stand assembly and for orienting of the fixed shaft member within the stand collar in at least one of two orientations.

In some embodiments the at least a keyway formed within the stand collar comprises a first keyway and a second keyway and wherein the first and second keyway are about ninety degrees circumferentially separated from each other about the fixed shaft member wherein the at least a keyway is for orienting of the fixed shaft member for affecting a flow through the drain passage to the other of the first chamber and second chamber due to the influence of gravity.

In some embodiments the downstem assembly comprises: an aerosol generating system wherein the aerosol generating system comprises a phyto material received area for receiving of a phyto material through an access opening and for heating of the phyto material disposed proximate the downstem assembly for when heated to a predetermined temperature for generating at least some aerosol from the heating of the phyto material where the movement of the liquid from the top elevated position within the one of the first chamber and second chamber to the lower of the other of the first chamber and second chamber results in a suction area about a lower portion of the one of the first chamber and second chamber and this induces at least one of air and the least some aerosol to flow from the downstem assembly and through the first shaft member fluid pathway and results in the at least one of air and the at least some aerosol to percolate upwardly through the volume of liquid downwardly flowing through the drain passage and for the percolated at least one of air and the at least some aerosol to gather into an upper area of the one of the first chamber and second chamber, wherein the downward movement of the liquid forces the at least one of air and the at least some aerosol disposed in the other of the first chamber and second chamber, that was received therein during the previous revolution of the rotatable water filtration assembly, through an exhaust opening fluidly connected with the fixed shaft member second fluid pathway, such that during each revolution of the rotatable water filtration assembly a volume of the at least one of air and the at least some aerosol is received within the one of the first chamber and second chamber and the previous volume of the at least one of air and the at least some aerosol received during the preceding revolution it exhausted from the other of the one of the first chamber and second chamber.

In some embodiments the downstem assembly comprising the aerosol generating system comprises a heating element assembly for controllably receiving of electrical energy from an electrical energy storage source and for heating of the phyto material proximate the heating element assembly to the predetermined temperature for creating of the at least some aerosol, wherein the heating of the phyto material proximate the heating element assembly comprises one of: wherein the phyto material comprises a phyto material extract, conductive heating of the phyto material extract disposed proximate the heating element assembly to the predetermined temperature for creating of the at least some aerosol where the predetermined temperature is between 500 and 700 degrees Fahrenheit and, wherein the phyto material comprises a phyto leaf material leaf, conductive heating of the phyto material leaf disposed proximate the heating element assembly to the predetermined temperature for creating of the at least some aerosol where the predetermined temperature is between 350 and 450 degrees Fahrenheit.

In some embodiments the downstem assembly comprising the aerosol generating system comprises a heating element assembly for controllably receiving of electrical energy from an electrical energy storage source and for heating of the phyto material proximate the heating element assembly to the predetermined temperature for creating of the at least some aerosol, wherein the heating of the phyto material proximate the heating element assembly comprises one of: wherein the phyto material comprises a phyto material extract, convective heating of the phyto material extract disposed proximate the heating element assembly to the predetermined temperature for creating of the at least some aerosol where the predetermined temperature is between 500 and 700 degrees Fahrenheit and, wherein the phyto material comprises a phyto leaf material leaf, convective heating of the phyto material leaf disposed proximate the heating element assembly to the predetermined temperature for creating of the at least some aerosol where the predetermined temperature is between 350 and 450 degrees Fahrenheit.

In some embodiments a stand collar is provided for supporting the fixed shaft member where the downstem assembly is releasably coupled with the stand collar and the downstem assembly comprises the aerosol generating system comprises a heating element assembly for controllably receiving of electrical energy from an electrical energy storage source and for heating of the phyto material proximate the heating element assembly to the predetermined temperature for creating of the at least some aerosol and where the at least some aerosol is for propagating through the first shaft member fluid pathway.

In some embodiments a stand collar is provided for supporting the fixed shaft member where the downstem assembly is releasably coupled with the stand collar and the downstem assembly comprises an external aerosol generating system for being fluidly coupled with the downstem assembly.

In some embodiments the stand assembly comprises: the stand collar for supporting the fixed shaft member and at least a keyway formed within the stand collar and the fixed shaft member having a keyseat, the downstem assembly comprising a downstem assembly keyway; a key disposed within the least a keyway and the keyseat and the downstem assembly keyway, the key for preventing rotation of the fixed shaft member in relation to the stand assembly and for orienting of the fixed shaft member within the stand collar and the downstem assembly in at least one of two orientations.

In some embodiments the rotatable water filtration assembly comprises: a chamber coupling member disposed approximately midway between the first chamber and the second chamber, the chamber coupling member having an outer surface and, a first floor facing the first chamber; a second floor spaced apart from the first floor and facing the second chamber; a proximal bore and a distal bore formed within the outer surface and penetrating therethrough, both proximal and distal bores being aligned for receiving the fixed shaft member and the distal bore extending through the chamber coupling member outer surface and being aligned for receiving of the fixed shaft member therein, the fixed shaft member proximal end extending proximally past the outer surface and the fixed shaft member distal end extending distally past the outer surface, wherein the proximal and distal bores are cylindrical and the fixed shaft member is cylindrical for the chamber coupling member to rotate about the fixed shaft member.

In some embodiments the chamber coupling member comprises: a first conduit extending from the first floor into the first chamber towards an outer end of the first chamber and back towards the first floor and terminating at a first outlet port; a second conduit extending from the second floor into the second chamber towards an outer end of the second chamber and back towards the second floor and terminating at a second outlet port, the movement of the liquid from the top elevated position within the one of the first chamber and second chamber to the lower of the other of the first chamber and second chamber results in a suction area about an upper portion proximate a respective outer end of the one of the first chamber and second chamber and this induces air to flow from the downstem assembly and through the first shaft member fluid pathway and results in the induced air flow through a respective one of first and second conduit and for the air to percolate from the respective one of first and second outlet port through the volume of liquid downwardly flowing through the drain passage and for the percolated air to gather into the upper area of the one of the first chamber and second chamber.

In some embodiments air moving through the downstem assembly may be channeled through said shaft member first fluid pathway to an upper suction area of one of the first chamber and the second chamber after each half revolution of the rotatable water filtration assembly, wherein the shaft member first fluid pathway extends radially from the shaft member towards opposite ends of the first and second chambers and through: a first conduit disposed within the first chamber and a second conduit disposed within the second chamber when the rotatable water filtration assembly is oriented in an approximately vertical position with its long axis approximately perpendicular to gravity.

In some embodiments the rotatable water filtration assembly comprises: a chamber coupling member disposed approximately midway between the first chamber and the second chamber, the chamber coupling comprising having an outer surface and, a first floor facing the first chamber; a second floor spaced apart from the first floor and facing the second chamber, formed within the outer surface and penetrating therethrough is a proximal bore and a distal bore, both being aligned for receiving the fixed shaft member.

In some embodiments the first conduit extending from the first floor into the first chamber towards the outer end of the first chamber and back towards the first floor at terminating at the first outlet port comprises a first reversing air path and where the first outlet port is spaced away from the first floor towards the outer end where in a first orientation of the rotatable water filtration assembly 100 the shaft member first fluid pathway is fluidly coupled with the first reversing air path.

In some embodiments the second conduit extending from the second floor into the second chamber towards the outer end of the second chamber and back towards the second floor at terminating at the second outlet port comprises a second reversing air path and where the second outlet port is spaced away from the second floor towards the outer end where in a first orientation of the rotatable water filtration assembly the shaft member first fluid pathway is other than fluidly coupled with the second reversing air path.

In some embodiments the second conduit extending from the second floor into the second chamber towards the outer end of the second chamber and back towards the second floor at terminating at the second outlet port comprises a second reversing air path and where the second outlet port is spaced away from the second floor towards the outer end where in a second orientation of the rotatable water filtration assembly the shaft member first fluid pathway is fluidly coupled with the second reversing air path.

In some embodiments the chamber coupling member comprises: a drain passage disposed between the first chamber and second chamber forming an opening between the first floor and the second floor and propagating through the space between the floors and being fluidly isolated from the proximal bore and the distal bore.

In some embodiments the rotatable water filtration assembly comprises the first chamber and second chamber which are generally equal volumes separated by a divider wall having the drain passage in the form of at least one drain opening formed therethrough that allows the liquid to move from one chamber to the other after each half turn of the rotatable water filtration assembly.

In accordance with an aspect of this disclosure a water filtration apparatus is disclosed comprising: downstem assembly for holding one of material to be combusted for generating a combustion aerosol and an aerosol generating system for generating an aerosol having a first fluid pathway disposed within a fixed shaft member and fluidly coupled with the downstem assembly; a rotatable water filtration assembly rotatably mounted about said fixed shaft member and including two chambers generally separated by a divider wall having drain passage formed therein and wherein the rotatable water filtration assembly is normally oriented vertically with one chamber being disposed over the other and wherein said chamber is adapted to contain a volume of liquid that moves from one chamber to the other through the drain passage in response to rotating the rotatable water filtration assembly one-half turn; generating one of the combustion aerosol and the aerosol and directing the one of the generated combustion aerosol and the aerosol through fixed shaft member and routing the one of the generated combustion aerosol and the aerosol through an upper disposed chamber and percolating the one of the generated combustion aerosol and the aerosol through the liquid as the liquid within said chamber moves from the upper oriented chamber to the lower oriented chamber after each half turn, the falling liquid creating a vacuum space above the falling liquid in the upper chamber that draws air through the one of the material to be combusted and the aerosol generating system and the one of the generated combustion aerosol and the aerosol flowing and percolating into the upper disposed chamber; and an exhaust opening operatively associated with the a rotatable water filtration assembly for normally maintaining the upper oriented chamber closed to exhaust and for maintaining the lower disposed chamber open to exhaust such that the falling liquid moving from the upper chamber to the lower chamber after each half turn forces the generated combustion aerosol and the aerosol contained in the lower chamber to be exhausted from said chamber via exhaust opening operatively associated with the rotatable water filtration assembly.

DETAILED DESCRIPTION

Figure 1A:
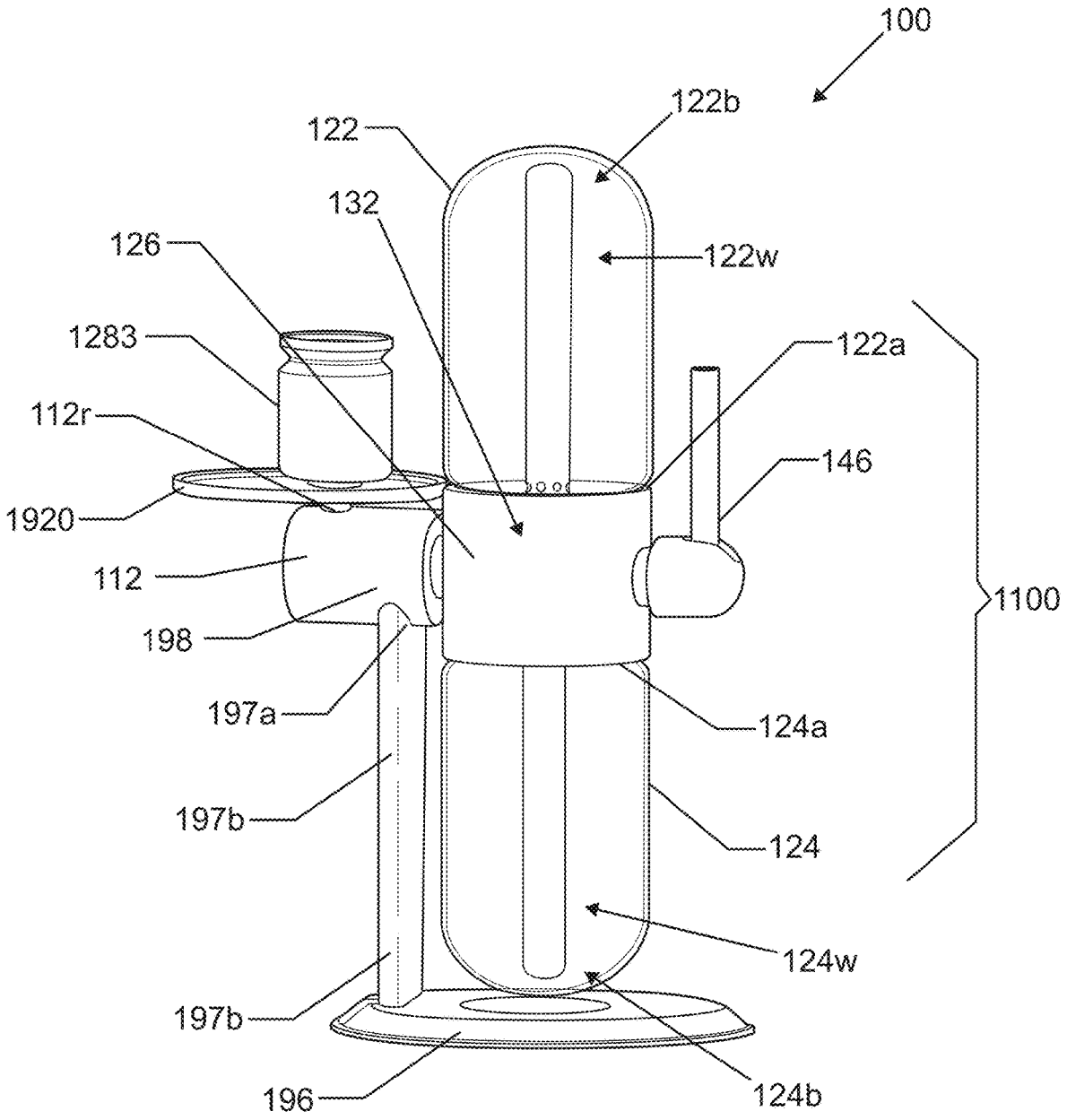
FIG. 1A illustrates a water filtration apparatus from a perspective view is shown in accordance as a first embodiment of the invention.

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising," and variations thereof mean "including but not limited to," unless expressly specified otherwise. A listing of items does not imply that any or all of the items are mutually exclusive, unless expressly specified otherwise. The terms "a," "an," and "the" mean "one or more," unless expressly specified otherwise.

For the terms upward and upwardly, in the disclosure, these are meant to reference opposite to gravity or opposite to a direction of gravity and the terms downward and downwardly and falling are meant to reference with gravity or with a direction of gravity.

Keller, U.S. Pat. No. 4,140,138 discloses a smoking apparatus that rotatably mounted liquid piston assembly that acts to pump air and resulting smoke through material being held or supported by the apparatus as the liquid piston assembly is manually turned in half turn intervals, where during each half turn or half cycle, one compartment is filled with smoke while the smoke already contained in the other compartment is exhausted. However other than the liquid piston assembly being used to pump air through the smoking apparatus the liquid contained therein does not filter the smoke propagating through the smoking apparatus, which does not provide for water pipe functionality and ends up creating harsh tasting vapor for the end user.

Houston, U.S. Pat. No. 10,342,255 also provides for similar functionality to Keller in that liquid contained within a gravity water pipe does not filter the smoke propagating through the smoking apparatus, which does not provide for water pipe functionality and ends up creating harsh tasting vapor for the end user. Neither Keller nor Houston disclose any percolating or water filtering features to cool the smoke as well as to water filter the smoke through percolation, as achieve in accordance with the embodiments of the invention as are described hereinbelow.

Figure 2A:
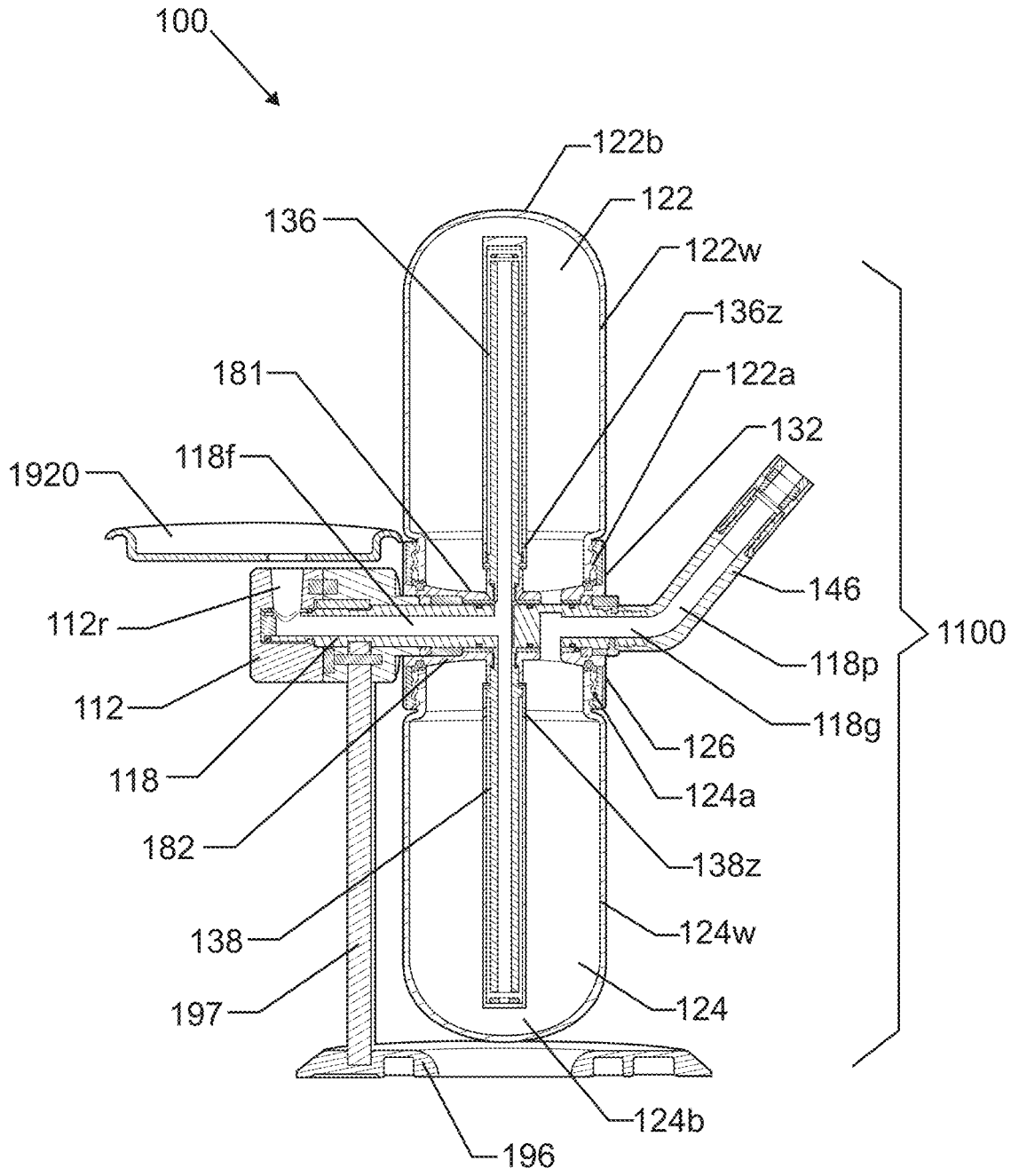
FIG. 2A illustrates a water filtration apparatus from a cutaway perspective view.
Figure 2B:
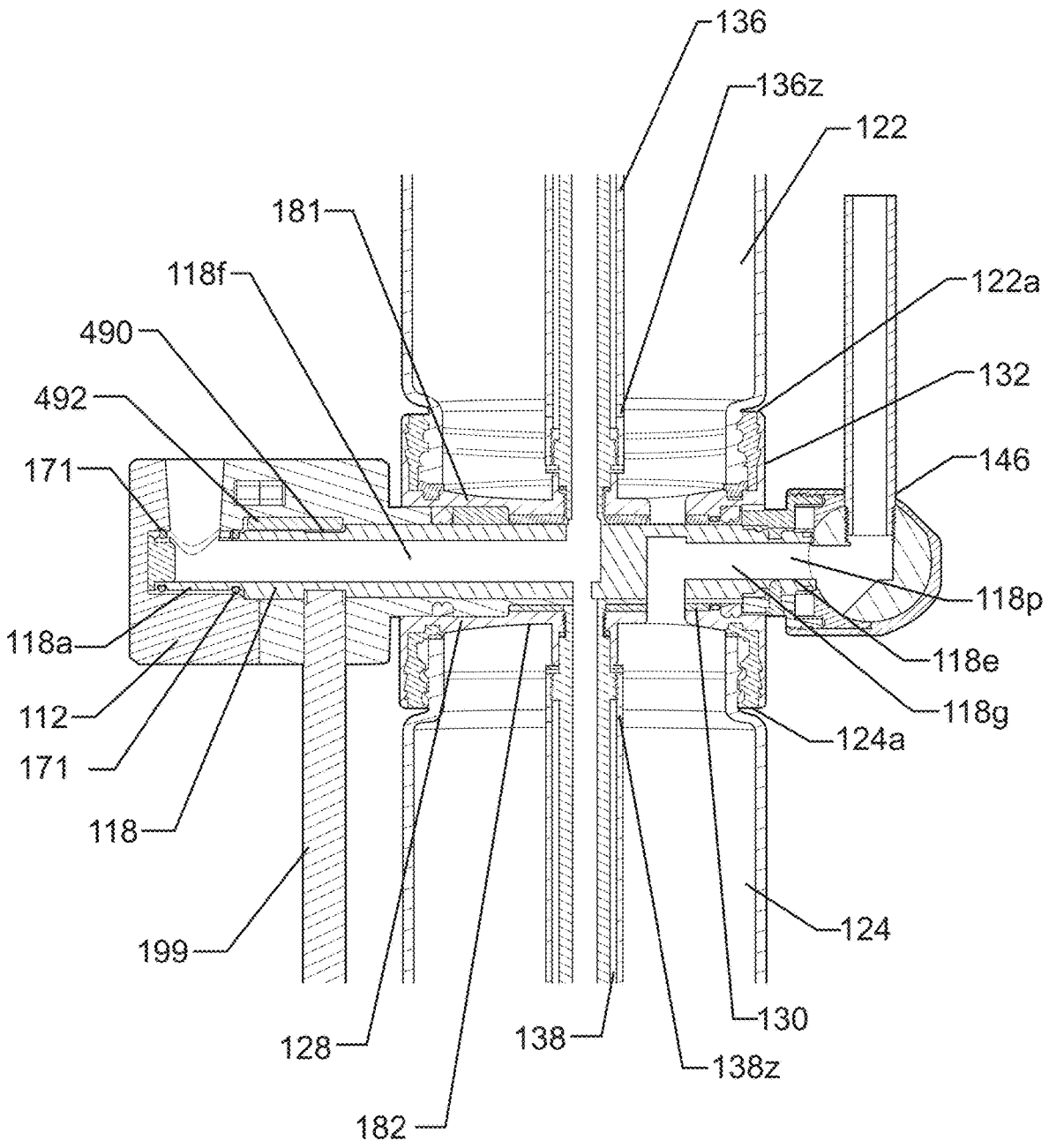
FIG. 2B illustrates a cutaway view of a rotatable water filtration assembly rotatively mounted about a fixed shaft member.

Referencing drawing FIG. 1A, FIG. 2A, and FIG. 2B, FIG. 1A illustrates a water filtration apparatus from a perspective view is shown in accordance with a first embodiment of the invention. A rotatable water filtration apparatus 100 may comprise a first chamber 122, outer end 122*b*, first outer wall structure 122*w*, a first coupling area 122*a*, a mouthpiece assembly 146, a second coupling area 124*a*, a second chamber 124, a second outer wall structure 124*w*, an outer end 124*b*, base assembly 196, a stand arm 197, a first end 197*a*, a second end 197*b*, a stand collar 198, downstem assembly 112, a tray 1920, a receiving port assembly 112*r*, a bowl 1283, a chamber coupling member 126, and a chamber coupling member outer surface 132. A rotatable water filtration assembly 1100 may be a combination of a first chamber 122, outer end 122*b*, first outer wall structure 122*w*, a first coupling area 122*a*, a second coupling area 124*a*, a second chamber 124, a second outer wall structure 124*w*, an outer end 124*b*. FIG. 2A, illustrates the rotatable water filtration apparatus 100 from a cutaway perspective view to better show the internal parts. FIG. 2A further shows a first outlet port 136*z*, a chamber coupling member outer surface 132, a shaft member output port 118*p*, a second outlet port 138*z*, a first conduit 136, a second conduit 138, a first floor 181, a second floor 182, and a downstem assembly receiving port 112*r*. FIG. 2B illustrates a cutaway view of a rotatable water filtration apparatus 100 rotatively mounted about a fixed shaft member 118.

With reference to FIGS. 1A, 2A and 2B, the rotatable water filtration apparatus 100 may include a downstem assembly 112 and a fixed shaft member 118, a key 492, a keyseat 490, a shaft member first fluid pathway 118*f*, a first floor 181, a first conduit 136, first outlet port 136*z*, a first chamber 122, a first coupling area 122*a*, a chamber coupling member outer surface 132, a second coupling area 124*a*, a second chamber 124, a distal bore 130, a second outlet port 138*z*, a second conduit 138, a second floor 182, a proximal bore 128, and a stand assembly 199, having a shaft member proximal end 118*a* fluidly coupled with a downstem assembly 112 and a distal end 118*e* fluidly coupled with a mouthpiece assembly 146, such that in an operating process air may enter the downstem assembly 112 and move through and into the fixed shaft member 118 into a the shaft member first fluid pathway 118*f* (FIG. 2B) from the shaft member proximal end 118*a* and into a shaft member second fluid pathway 118*g* and out from the distal end 118*e*, wherein the shaft member first fluid pathway 118*f* and the shaft member second fluid pathway 118*g* are other than fluidly coupled together within the fixed shaft member 118, as shown in FIG. 2B.

With reference to FIG. 2A, 2B a rotatable water filtration apparatus 100 rotatively mounted about said fixed shaft member 118 for pulling air through the downstem assembly 112 into the shaft member first fluid pathway 118*f* and for pushing air into the distal end 118*e* of the fixed shaft member 118 through the fixed shaft member second fluid pathway 118*g* in response to the rotatable water filtration assembly 1100 being rotated about said fixed shaft member 118, wherein the rotatable water filtration assembly 1100 may include a first chamber 122 adapted to contain a volume of liquid less than a total capacity of the first chamber and a second chamber 124 adapted to contain the volume of liquid less than a total capacity of the second chamber and a drain passage 134 disposed between the first chamber 122 and second chamber 124 for allowing of liquid to drain therethrough under an influence of gravity. The drain passage 134 may be shown in more detail in FIG. 2C and FIG. 2D.

In conjunction with the aforementioned figures, the rotatable water filtration assembly 1100 may include a chamber coupling member 126 disposed approximately midway between the first chamber 122 and the second chamber 124, the chamber coupling member 126 may have a chamber coupling member outer surface 132 and a first floor 181 facing the first chamber 122 and a second floor 182 spaced apart from the first floor 181 and facing the second chamber 124.

Figure 2C:
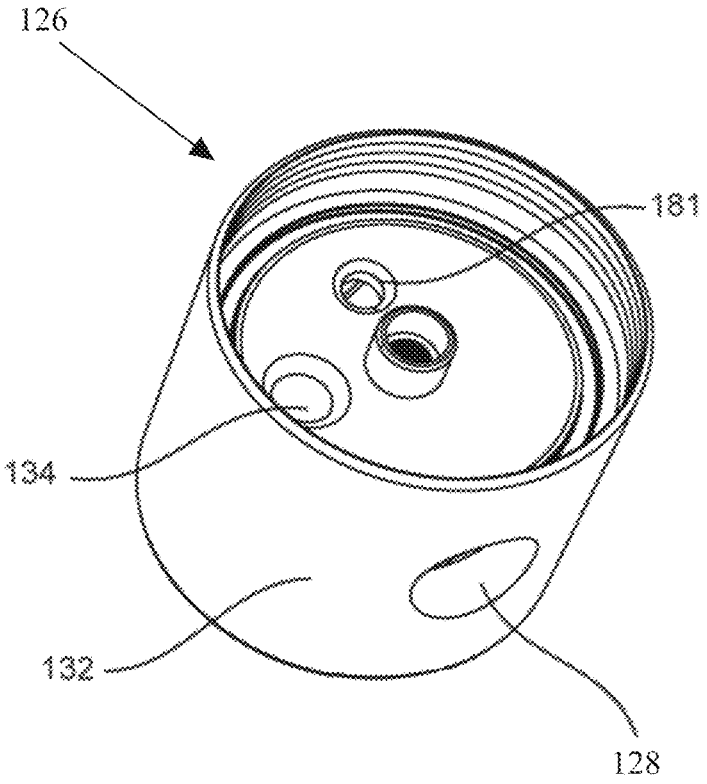
FIG. 2C illustrates a perspective top view of a chamber coupling member showing a drain passage.

With reference to FIGS. 2B and 2C, formed within the chamber coupling member outer surface 132 and penetrating therethrough may be a proximal bore 128 and a distal bore 130, both being aligned for receiving the fixed shaft member 118.

With respect to the rotatable water filtration apparatus 100 in detail, such as that shown in FIG. 1A, the first chamber 122 and the second chamber 124 may be about opposite sides of the chamber coupling member 126. The first chamber 122 and second chamber 124 are preferably transparent and may be constructed of glass, plastic or the like and include chamber coupling member 126 first coupling area 122*a* and second coupling areas 124*a*, and a first outer ends 122*b* and a second outer ends 124*b* and at least a respective first outer wall structure 122*w* and second outer wall structure 124*w*.

With reference to FIG. 2A, In in some embodiments, each of the first chamber 122 and the second chamber 124 may be adapted to be screwed on and off at their first and second coupling areas 122*a* and 124*a* through grasping of the first chamber 122 and the second chamber 124 proximate their outer ends 122*b* and 124*b* in order to fill a respective chamber with a liquid such as water. It will be understood, however, that the first chamber 122 and second chamber 124 may be provided with threads about the first and second coupling areas 122*a* and 124*a* or a neck areas thereof such that each chamber may be screwed to the chamber coupling member 126, it may also be envisaged to use a magnetic coupling or a bayonet coupling.

Referring to FIGS. 1A and 2A, the rotatable water filtration apparatus 100 may include the stand assembly 199 which may include a stand collar 198 for supporting the fixed shaft member 118 and a stand arm 197 having a first end 197*a* coupled with the stand collar 198 and a second end 197*b* extending radially from the stand collar towards a base assembly 196 transversely oriented with the stand arm 197.

The stand assembly 199 may be coupled with the fixed shaft member 118 and for supporting of the fixed shaft member 118 and for orienting of the fixed shaft member 118 with the orientation with respect to gravity.

Figure 1B:
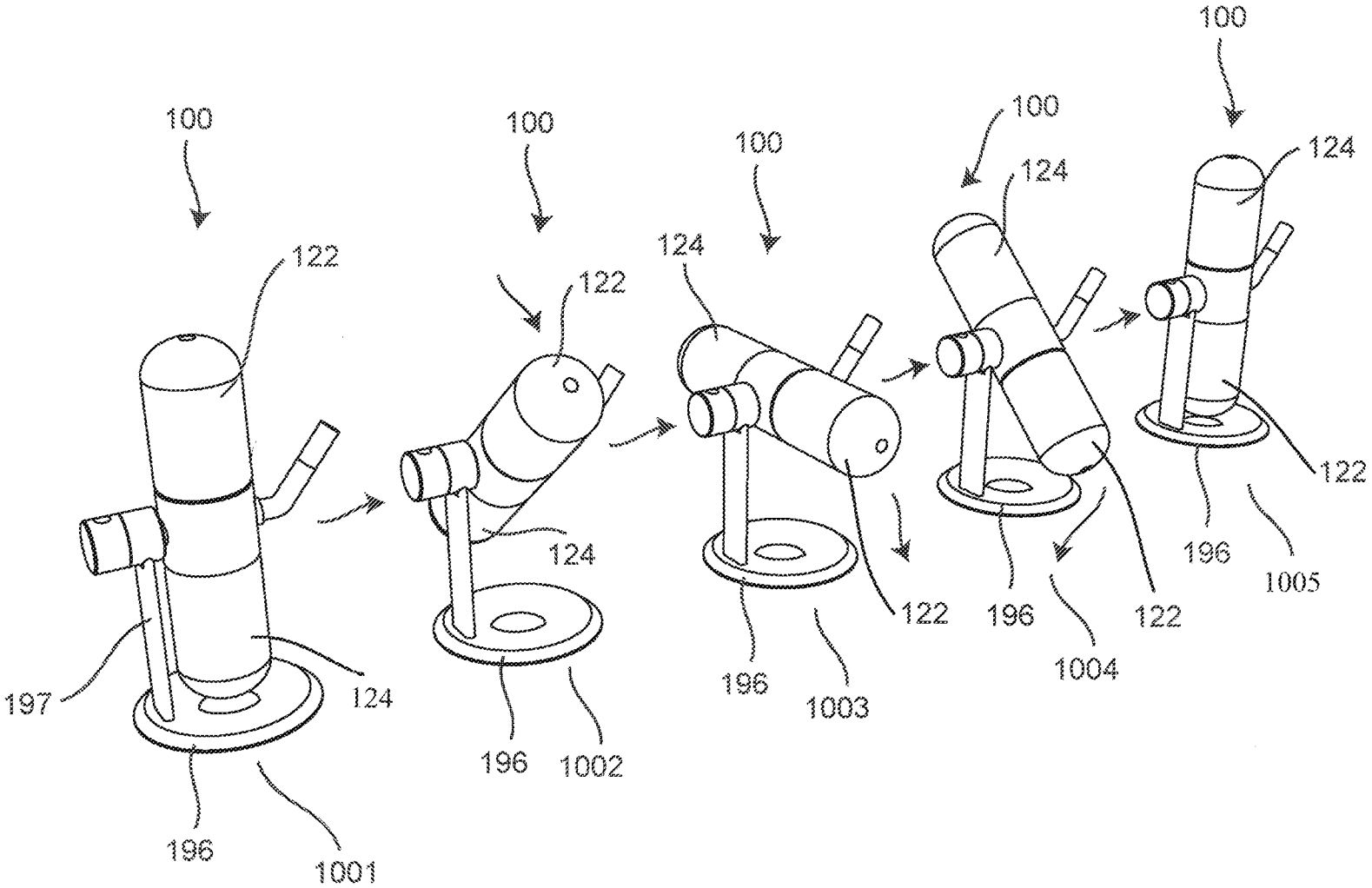
FIG. 1B illustrates a water filtration apparatus from a perspective view is shown in accordance as a first embodiment of the invention and shown in rotating operation.

Referring to FIG. 1B, in use of the rotatable water filtration assembly 100, it may be generally rotated about the fixed shaft member 118, as shown in FIG. 2A, that is held in place by a stand arm 197 and a base assembly 196, in response to an external force being applied to at least one of the first chamber 122 and the second chamber 124 proximally to their ends, 122*b* and 124*b*. In some embodiments this external force or rotating force may be provided by a user using their hand.

Rotations of the rotatable water filtration assembly 1100 are generally depicted where the rotatable water filtration assembly 1100 may rotate from a first position 1001, to a second position 1002, to a third position 1003, to a fourth position 1004, to a fifth position 1005. For a second position 1002 and fourth position 1004, the rotatable water filtration assembly 1100 may be oriented about 45 degrees with respect to gravity and at position 1003 the rotatable water filtration assembly 1100 may be oriented about perpendicular with gravity in the third position 1003. In the first position 1001, the first chamber 122 may be disposed above the second chamber 124 and in the fifth position 1005 the first chamber 122 may be disposed below the second chamber 124 Above and below may be interpreted as meaning an orientation with respect to gravity. From the first position 1001 to the fifth position 1005, the rotatable water filtration assembly 1100 may be generally rotated at a rotation angle of about 180 degrees about the fixed shaft member 118. In some embodiments this rotation angle may be about 165 degrees to about 195 degrees.

Figure 2D:
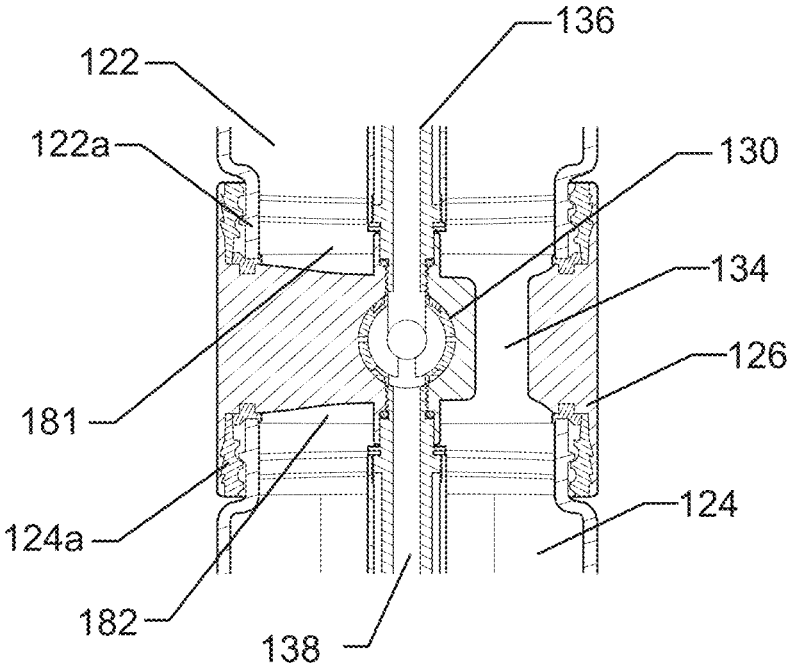
FIG. 2D illustrates a cutaway view of a chamber coupling member showing a drain passage and a first conduit and a second conduit proximate a floor of the chamber coupling member.
Figure 2E:
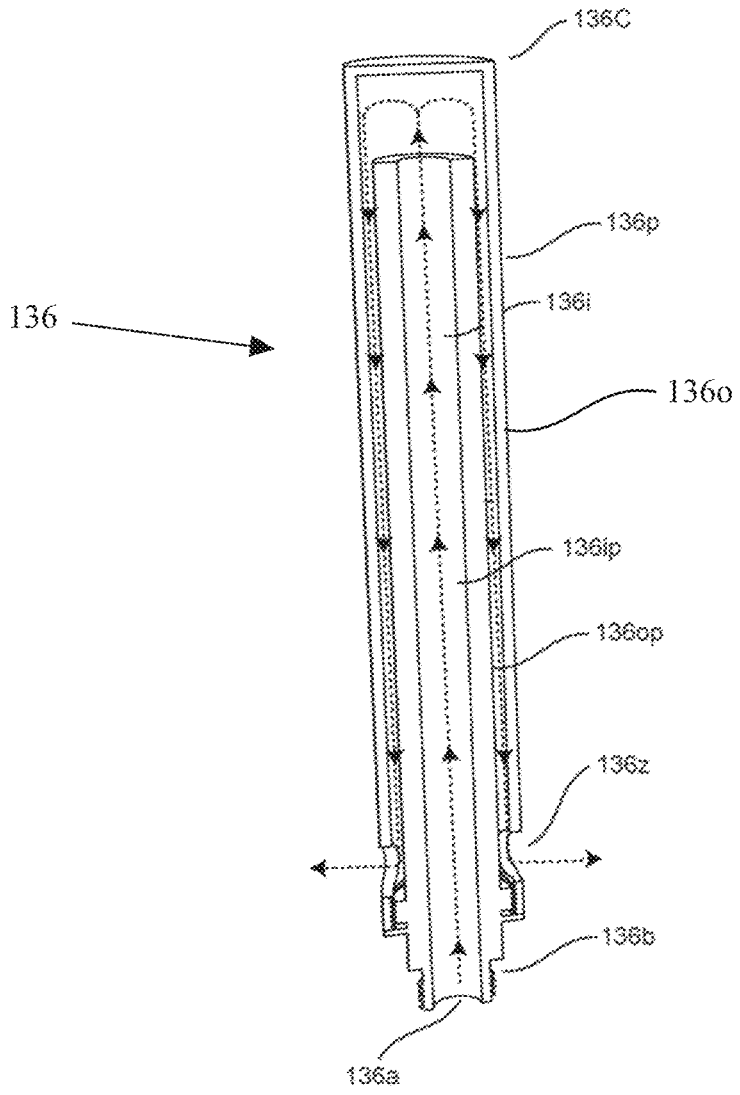
FIG. 2E illustrates a first conduit and showing a first reversing air path.
Figure 2F:
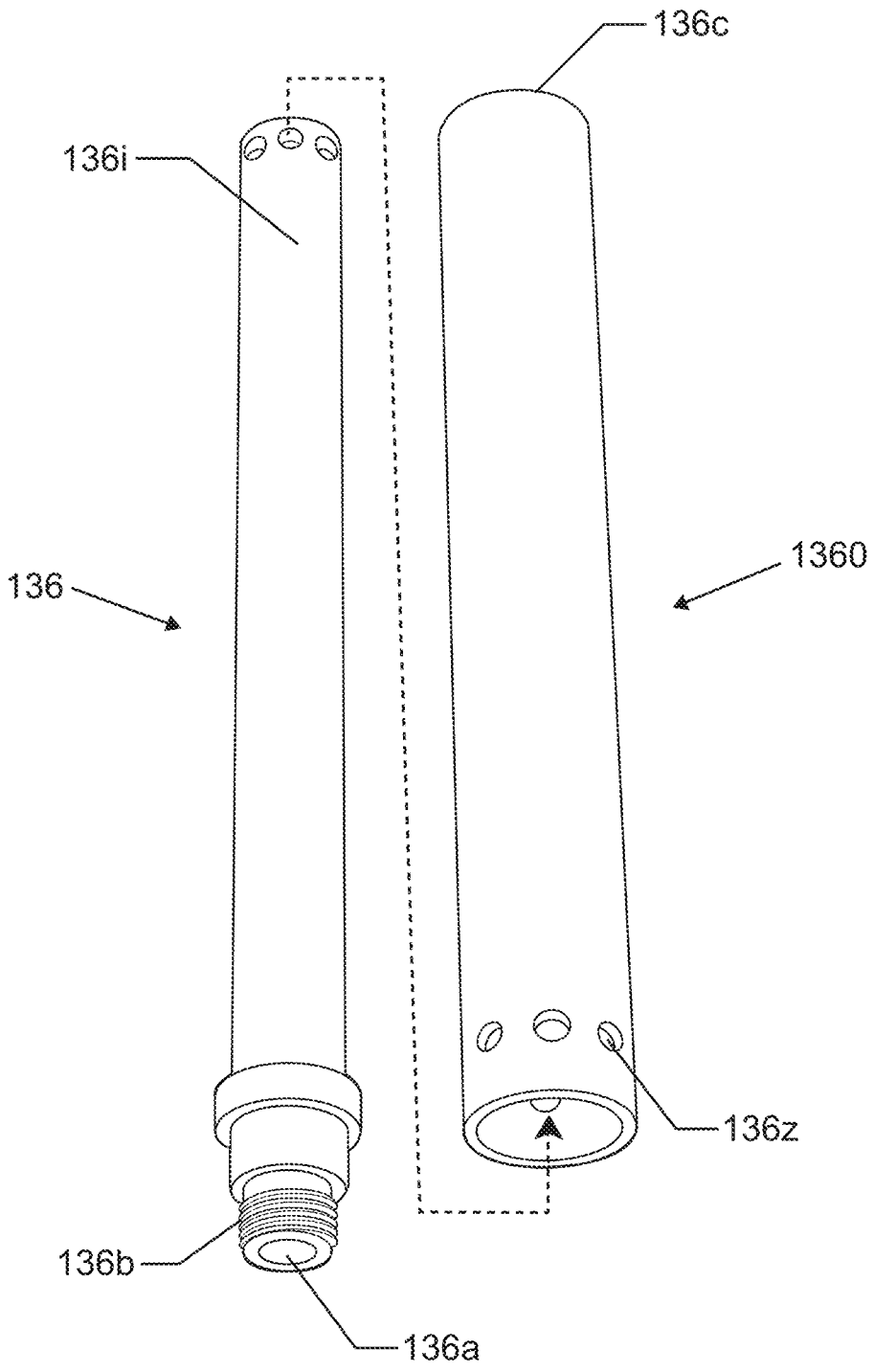
FIG. 2F illustrates a first conduit disassembled showing a first inner conduit and a first outer conduit.
Figure 3A:
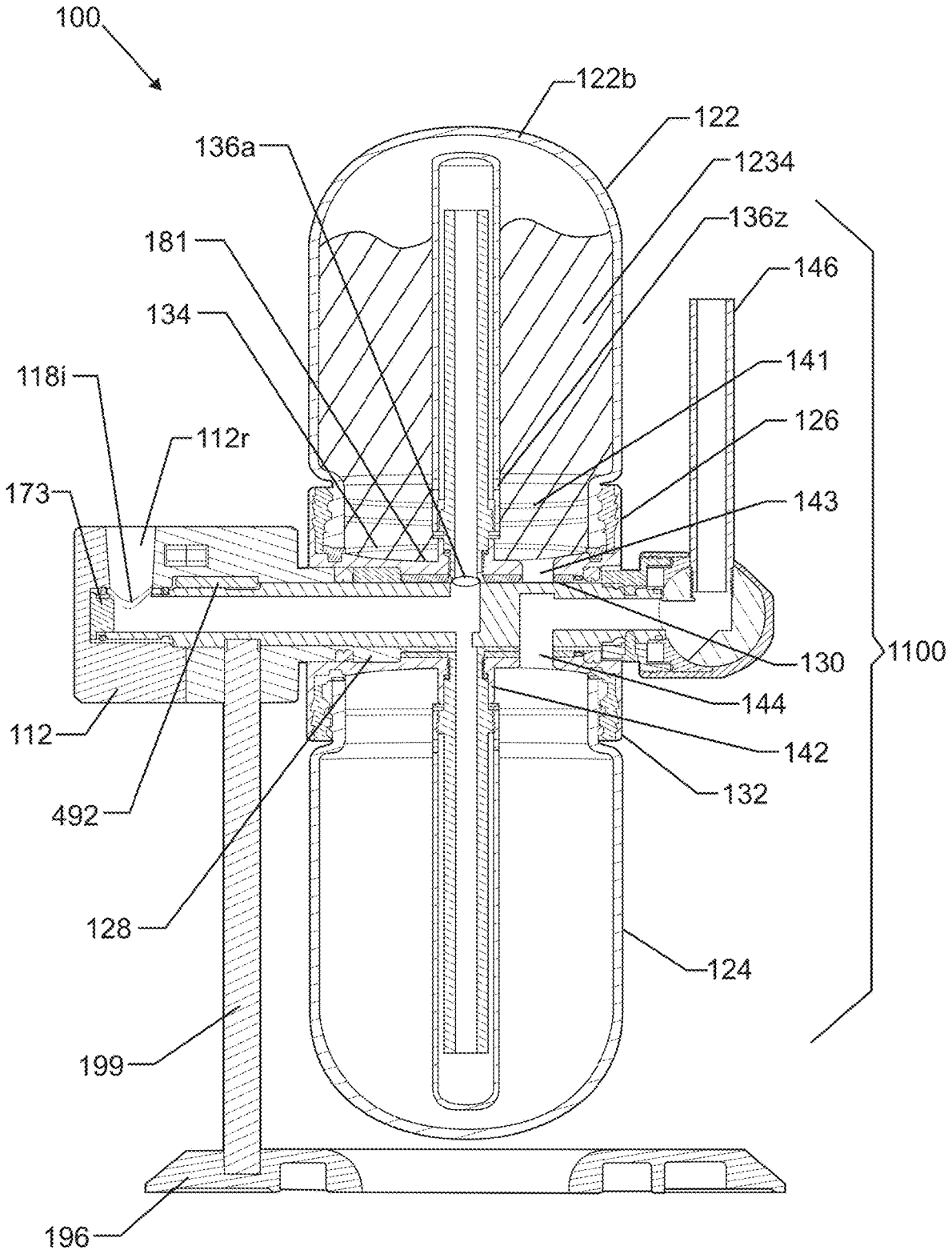
FIG. 3A illustrates a volume of liquid after an approximately half a full revolution of a rotatable water filtration assembly assumes a generally top elevated position within one of a first chamber and a second chamber.

Referring to FIG. 2E, FIG. 2F, and FIG. 3A, the chamber coupling member 126 may include a first conduit 136 extending from the first floor 181 into the first chamber 122 proximate the first coupling area 122*a* towards the outer end 122*b* of the first chamber 122 and back towards the first floor 181 and terminating at a first outlet port 136*z*. A second conduit 138 may extend from the second floor 182 into the second chamber 124 towards an outer end 124*b* of the second chamber 124 and back towards the second floor 182 and terminating at a second outlet port 138*a*. FIG. 2B and FIG. 2D show a cutaway perspective view of the first conduit 136 and the second conduit 138, which may be substantially similar to each other in form and function.

Figure 2G:
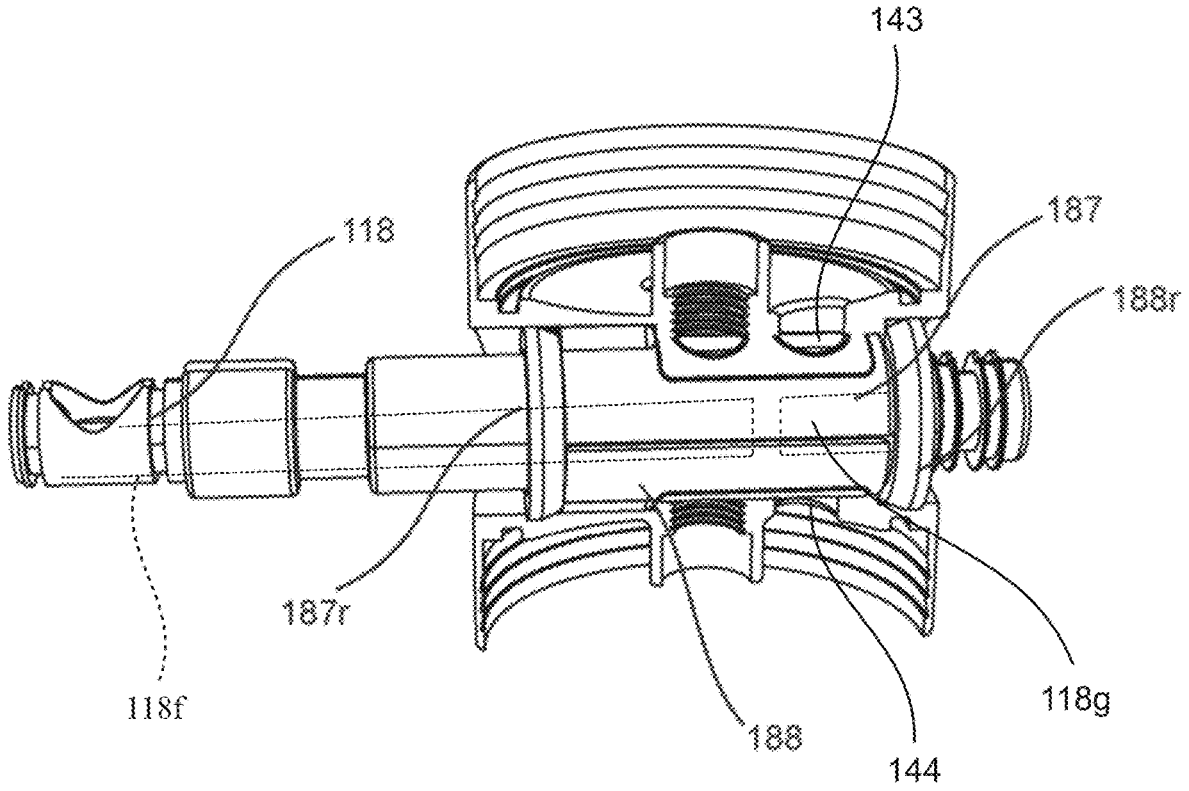
FIG. 2G illustrates a cutaway view of a chamber coupling member with first and second sealing members frictionally engaged therewith and in additional first and second rotatory shaft seals are shown.

Referring to FIG. 2F 2E and FIG. 2G 2F the first conduit 136 may include a first reversing air path 136*p* and where the first outlet port 136*z* may be spaced away from the first floor 181 towards the outer end 122*b* when the first conduit 136 may be coupled with the chamber coupling member 126.

The first conduit 136 may include a first conduit inlet port 136*a* at a first conduit inner end 136*b* for fluidly being coupled with the shaft member first fluid pathway 118*f*. The first conduit 136 may generally be formed from a first inner conduit 136*i* and a first outer conduit 1360, where the inner and outer conduits may be coaxial with one another and the inner conduit may be formed within the outer conduit and radially spaced apart from the outer conduit. The first inner conduit 136*i* may include a first inner fluid pathway 136*ip* therein and that extends from the first conduit inlet port 136*a* and outwardly towards a first conduit outer end 136*c* and between an outside wall of the first inner conduit 136*i* and an inside wall of the first outer conduit there may be formed a first outer fluid pathway 136*op* that propagates proximate the first conduit outer end 136*c* towards the first inner end 136*b* and terminating at the first conduit outlet port 136*z*. The first reversing air path 136*p* may then be formed from the first inner fluid pathway 136*ip* and the first outer fluid pathway 136*op*. There the first inner fluid pathway 136*ip* propagates in an outward direction and the first outer fluid pathway 136*op* propagates in an inward direction and the first inner fluid pathway 136*ip* and the first outer fluid pathway 136*op* are approximately parallel with one another.

The first reversing air path may be a circuitous air path from the first conduit inlet port 136*a* to the first conduit outlet port 136*z*. In some embodiments the first and second conduits may not be coaxial and may be parallel with one another. The second conduit 138 may have a similar construction with the first conduit 136 and is not shown in detail herein.

FIGS. 2E and 2F illustrates a first conduit and showing a first reversing air path. As shown in FIG. 2E the first conduit 136 may comprise a first conduit inlet port 136*a*, a first conduit outer end 136*c*, a first reversing air path 136*p*, a first inner conduit 136*i*, a first outer conduit 1360, a first inner fluid pathway 136*ip*, a first outer fluid pathway 136*op*, a first conduit outlet port 136*z*, and a first conduit inner end 136*b*. FIG. 2F illustrates the first inner conduit 136*i* separated from the first outer conduit 1360 with an arrow indication how these two conduits may be assembled with one another. The inner and outer conduits may be formed from metal extrusion tubing or glass tubing or plastic tubing and may have a threaded or magnetic connection proximate the first conduit inner end 136*b* for being releasably coupled with the chamber coupling member 126.

Figure 1C:
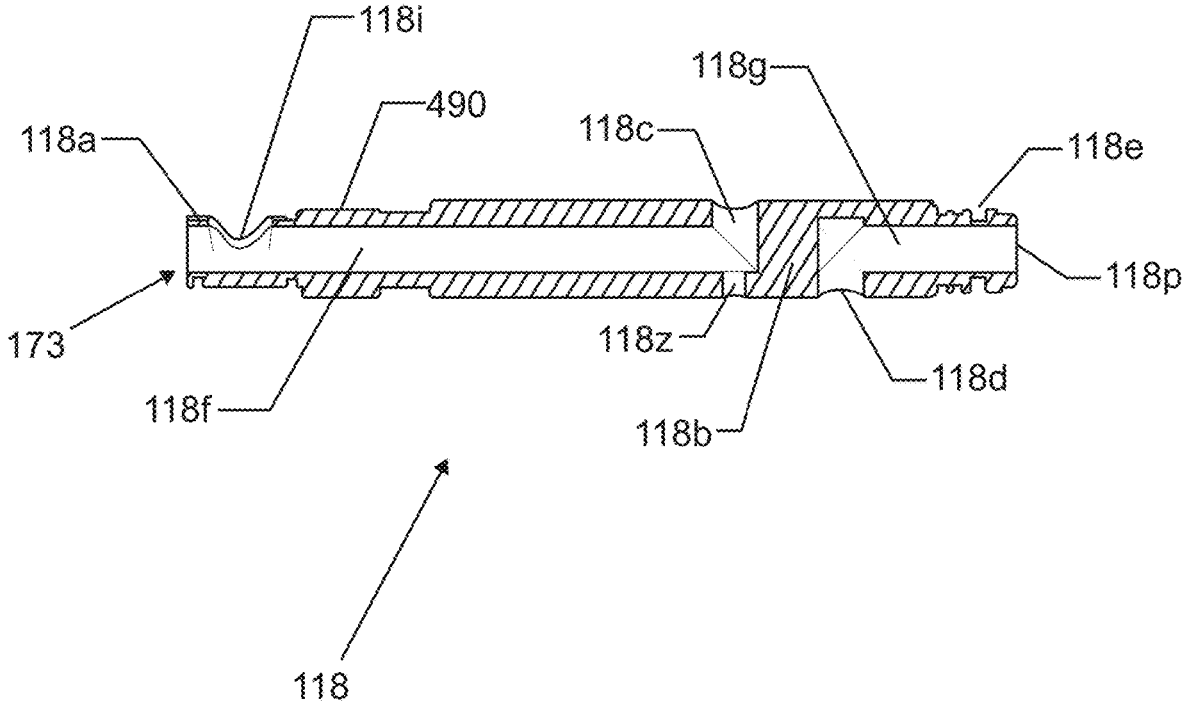
FIG. 1C illustrates a cutaway side view of a fixed shaft member.

FIG. 1C illustrates a cutaway side view of the fixed shaft member. The fixed shaft member 118 having a proximal plug 173 (FIG. 1G), shaft member proximal end 118*a*, an inlet opening 118*i*, a the shaft member first fluid pathway 118*f*, a keyseat 490, a first fluid pathway outlet opening 118*c*, a second fluid pathway opening 118*z*, a stop member 118*b*, the shaft member second fluid pathway 118*g*, a distal end 118*e*, and a shaft member output port 118*p*. The proximal plug 173 may be disposed at the proximal end thereof for sealing of the shaft member first fluid pathway 118*f* from receiving air other than from an inlet opening 118*i*. The shaft member proximal end 118*a* of the fixed shaft member 118 may be fluidly and frictionally coupled with the downstem assembly 112 as shown in FIG. 2A. The fixed shaft member 118 may be configured to have a keyseat 490, which may be configured to accept a key 492, as shown in FIG. 2B. The keyseat 490 may be configured to prevent rotation of the fixed shaft member 118 when configured to be fluidly and frictionally coupled to a downstem assembly 112 as shown in FIG. 2B. The inlet opening 118*i* may be configured to allow air to flow into the shaft member first fluid pathway 118*f*. The shaft member first fluid pathway 118*f* may be configured for air to flow to the first fluid pathway outlet opening 118*c* and a second fluid pathway 118*z*. The shaft member proximal end 118*a* may be configured to allow air to flow through the shaft member second fluid pathway 118*g* and out through a shaft member output port 118*p*. The distal end 118*e* may be configured to couple to a mouthpiece 146, as shown in FIG. 2A.

Figure 1D:
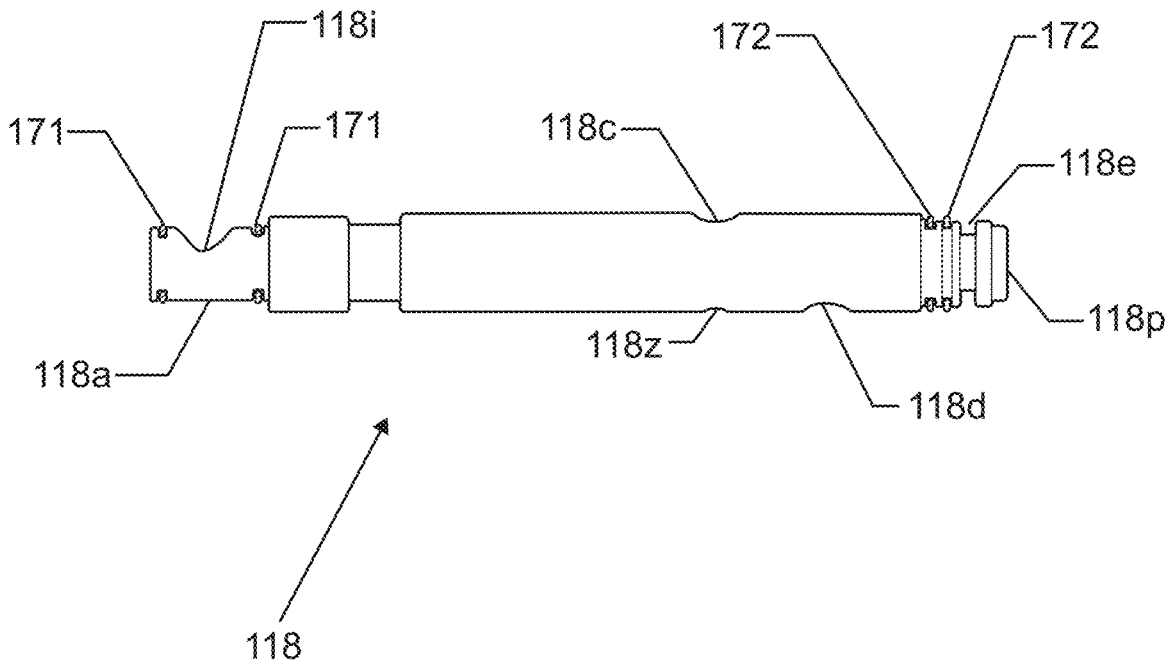
FIG. 1D illustrates a side view of a fixed shaft member.

FIG. 1D illustrates a side view of the fixed shaft member 118 with a first set of elastomeric sealing rings 171 disposed proximate the shaft member proximal end 118*a* and a second set of elastomeric sealing rings 172 disposed proximate the distal end 118*e*. The first set of elastomeric sealing rings 171, as shown in FIG. 2B, frictionally engage with the with the downstem assembly 112 for fluidly sealing of the inlet opening 118*i* with the downstem assembly 112 and more specifically with a downstem assembly receiving port 112*r*, which may be for receiving of phyto material or phyto material extract or for receiving of vapor. First fluid pathway outlet 118*c* may be configured to allow air to flow from fixed shaft member 118 into conduit 136, as shown in FIG. 2A. Fixed shaft member 118 is further coupled to mouthpiece assembly 146 through shaft member output port 118*p*.

FIGS. 1C, 1D, 1E, 1F, 1G, 1H, and 1*i* further reference the fixed shaft member 118 may have a keyseat 490 that may be configured to prevent rotation of the fixed shaft member 118 when configured to be fluidly and frictionally coupled to a downstem assembly 112 as shown in FIG. 2B. It may be seen from the figures that the fixed shaft member 118 includes a generally elongated hollow tubular member including a the shaft member first fluid pathway 118*f*, as shown in FIG. 1C, as an air, smoke, or aerosol inlet segment at the shaft member proximal end 118*a* that leads from the inlet opening 118*i* with the downstem assembly 112 to an intermediate area where a stop member 118*b* extends across the fixed shaft member 118 so as to block flow directly to the shaft member second fluid pathway 118*g*, where the shaft member first fluid pathway 118*f* and the shaft member second fluid pathway 118*g* are other than fluidly coupled together within the fixed shaft member 118 and are selectively fluidly coupled with each other through the first and second chambers, 122 and 124.

Figure 1E:
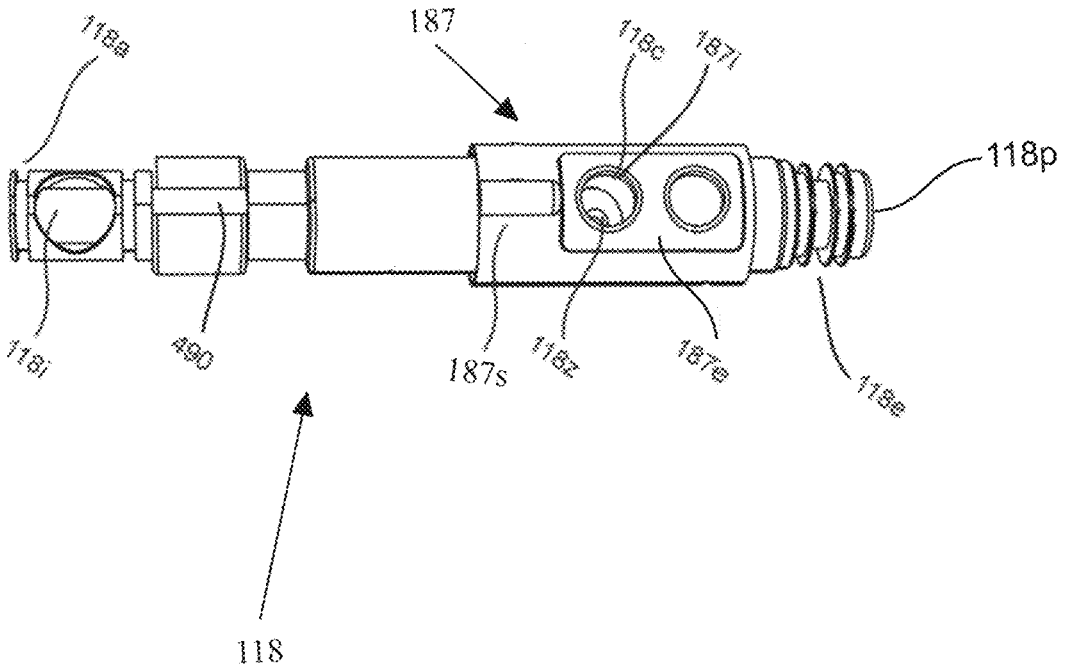
FIG. 1E illustrates a fixed shaft member from an upper perspective view.
Figure 1F:
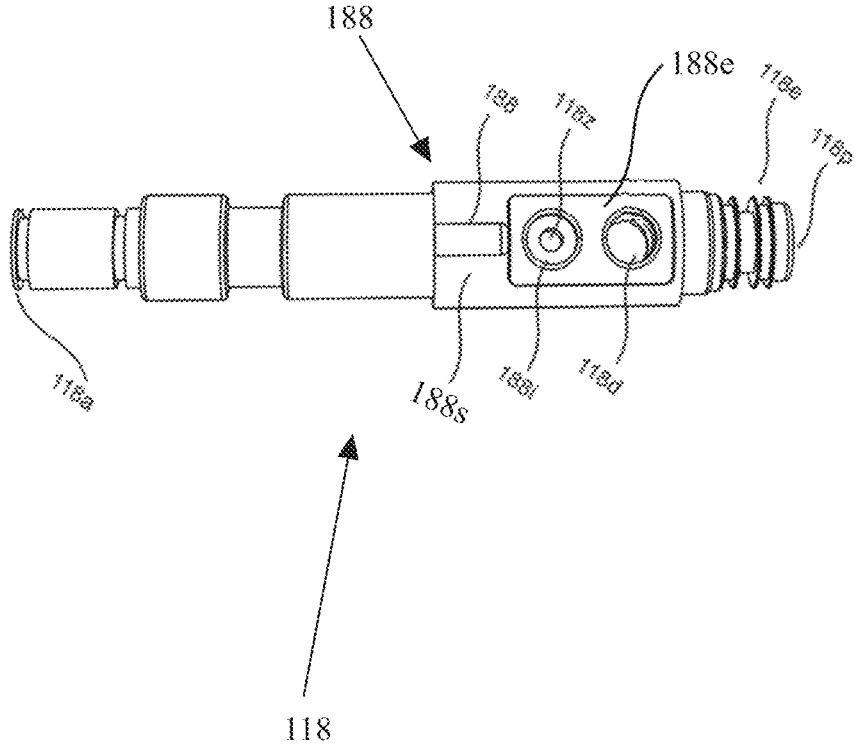
FIG. 1F illustrates a fixed shaft member from a lower perspective view.
Figure 1G:
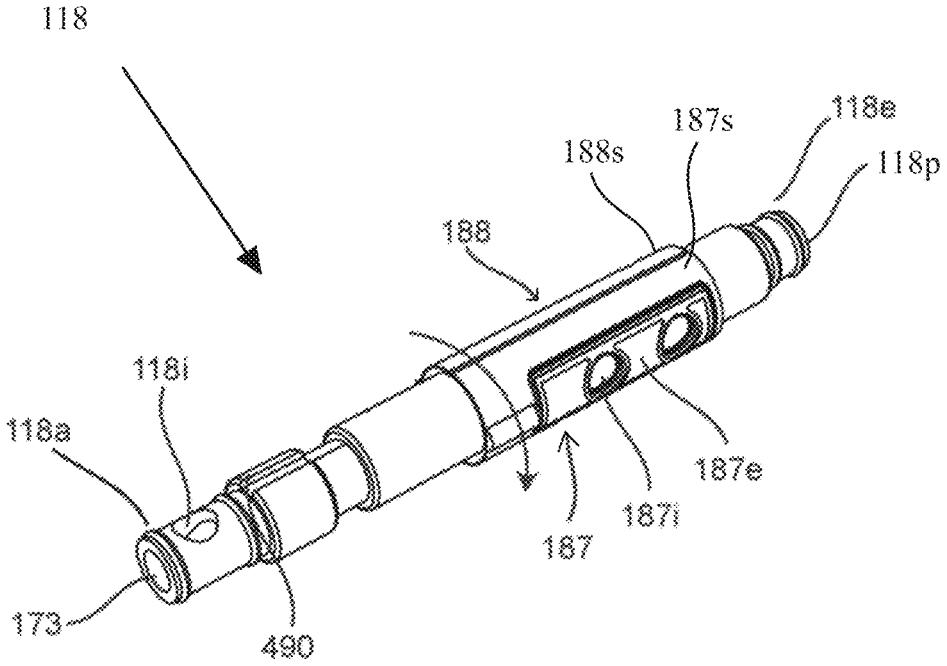
FIG. 1G illustrates first and second sealing members frictionally engaged with a fixed shaft member.
Figure 1H:
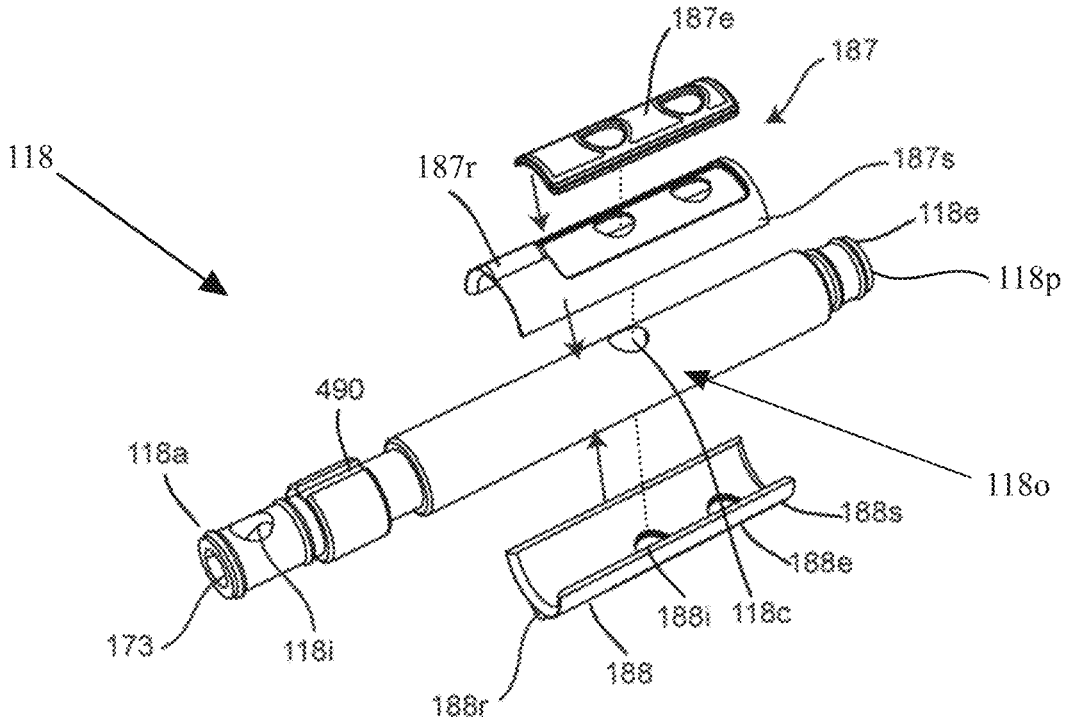
FIG. 1H illustrates first and second sealing members removed from a fixed shaft member.

With reference to FIGS. 1E, 1F, and 1H, FIG. 1E illustrates the fixed shaft member 118 from an upper perspective view and FIG. 1F illustrates the fixed shaft member 118 from a lower perspective view. As shown in FIGS. 1E and 1H fixed shaft member 118 may comprise a proximal end 118*a*, a first sealing members 187, first fluid pathway outlet opening 118*c*, first intake port 187*i*, a shaft member output port 118*p*, a distal end 118*e*, first exhaust port 187*e*, a second fluid pathway outlet opening 118*z*, a keyseat 490, and an inlet opening 118*i*. As shown in FIG. 1F fixed shaft member 118 may further comprise a proximal end 118*a*, a second sealing member 188, a second fluid pathway outlet opening 118*z*, a distal end 118*e*, a shaft member output port 118*p*, an exhaust opening 118*d*, a second intake port 188*i*, a second exhaust port 188*e*, a first sealing member registration feature 187*r*, a second sealing member registration feature 188*r*, and the outside 118*o* of the fixed shaft member 118.

The shaft member first fluid pathway 118*f* formed within the fixed shaft member 118 terminates proximally before the stop member 118*b* where proximally from the stop member 118*b* may be a first fluid pathway outlet opening 118*c*, which may be formed about one of an upper side of the fixed shaft member 118, and a second fluid pathway outlet opening 118*z* and may also be formed about a lower side of the fixed shaft member 118. The first fluid pathway outlet opening 118*c* and the second fluid pathway outlet opening 118*z* may be particularly positioned with respect to the rotatable water filtration assembly 1100 such that the first conduit 136 and the second conduit 138 rotate about this area of the fixed shaft member 118 where the first fluid pathway outlet opening 118*c* may be positioned to fluidly couple with the first conduit inlet port 136*a* and the second fluid pathway outlet opening 118*z* may also couple with the second conduit inlet port 138*a* and in some embodiments may couple with both of the first conduit inlet port 136*a* and the second conduit inlet port 138*a* when the rotatable water filtration assembly 1100 may be proximate the first position 1001 or proximate the second position 1005. When the first fluid pathway outlet opening 118*c* may be positioned to fluidly couple with both the first conduit inlet port 136*a* and may also couple with the second conduit inlet port 138*a* then the first fluid pathway outlet opening 118*c* and the second fluid pathway outlet opening 118*z* forms apertures in both of the upper and lower sides of the fixed shaft member 118. The second fluid pathway outlet opening 118*z* may allow some water through the first conduit 136 or the second conduit 138.

When the first fluid pathway outlet opening 118*c* may be positioned to fluidly couple with only the first conduit inlet port 136*a* proximate the first orientation then the first fluid pathway outlet opening 118*c* forms an apertures in the upper sides of the fixed shaft member 118 and when the first fluid pathway outlet opening 118*c* may be positioned to fluidly couple with only the second conduit inlet port 138*a* proximate the second orientation then the first fluid pathway outlet opening 118*c* forms an apertures in the upper sides of the fixed shaft member 118. This may be illustrated in FIG. 1J, where chamber coupling member 126 has been removed for clarity. As shown in FIG. 1J, fixed shaft member 118 is inserted with first sealing member 187 and second sealing member 188 into a chamber coupling member 126, which has been removed for clarity, further showing a the shaft member proximal end 118*a*, inlet opening 118*i*, stand collar 198, a first sealing member 187, the first fluid pathway outlet opening 118*c*, a first conduit inlet port 136*a*, a second bore engagement member 187*e*, a mouthpiece assembly 146, an exhaust opening 118*d*, a second bore engagement member 188*e*, a second conduit inlet port 138*a*, a second sealing member 188, and a stand assembly 199.

Formed on the opposite side of the stop assembly 118*b* and distally therefrom may be an exhaust opening 118*d*, and this opening may be particularly positioned about the lower side of the fixed shaft member 118. The second fluid pathway 118 may be proximally formed at the exhaust opening 118*d* and propagates distally to the fixed shaft member distal end 118*e* and terminates at a shaft member output port 118*p*, which may be fluidly coupled with the mouthpiece assembly 146.

Figure 1I:
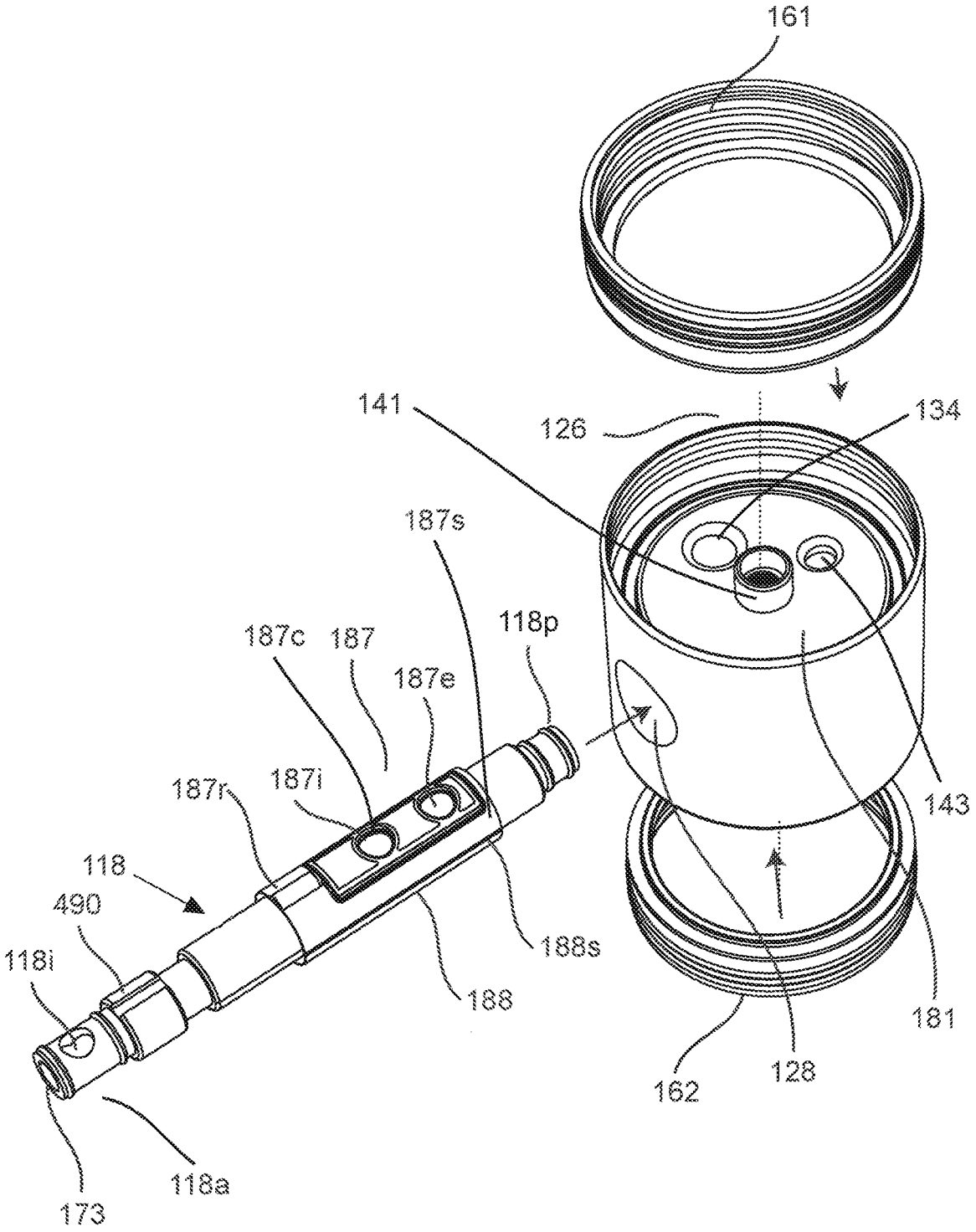
FIG. 1*i* illustrates a fixed shaft member for being inserted with first and second sealing members into a chamber coupling member.
Figure 1J:
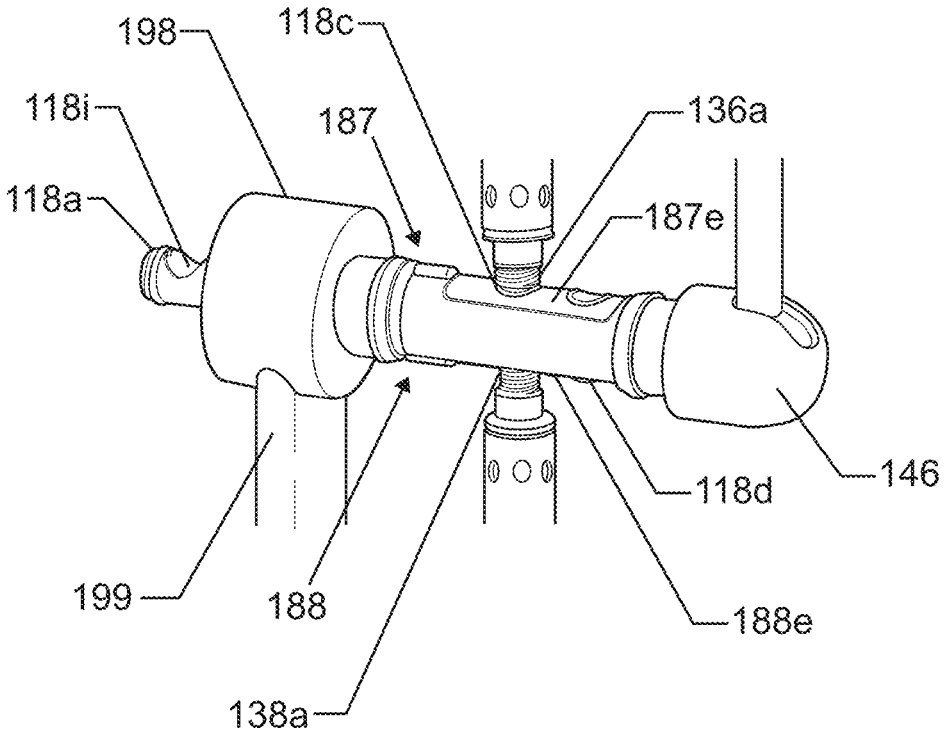
FIG. 1J illustrates a fixed shaft member inserted with first and second sealing members into a chamber coupling member, which is shown removed for clarity.

Referring to FIGS. 1G, 1H, and 1*i*, first and second sealing members, 187 and 188 may be provided for providing a relatively tight fit or an approximately waterproof seal between an exterior of the fixed shaft member 118 and the proximal bore 128 and the distal bore 130. The first and second sealing members, 187 and 188 may be fixed in place within the chamber coupling member 126 through first sealing member registration feature 187*r* and a second sealing member registration feature 188*r*. The proximal and distal bores are cylindrical and the fixed shaft member 118 outer surface may be cylindrical for the first and second sealing members, 187 and 188 engaged and rotationally fixed with the chamber coupling member 126, where the first and second sealing members, 187 and 188 rotate about the fixed shaft member 118.

The first and second sealing members, 187 and 188 may be provided with a first and second shaft engagement member 187*s*, 188*s* and with an elastomeric first and second bore engagement member 187*e*, 188*e*. The first and second shaft engagement member 187*s*, 188*s* may be for engaging the outside 118*o* of the fixed shaft member 118 and the elastomeric first and second bore engagement member 187*e*, 188*e* radially extend from the first and second shaft engagement member 187*s*, 188*s* and frictionally engaged the proximal bore 128 and the distal bore 130. As shown in FIG. 1*i*, a fixed shaft member 118 may be inserted with first sealing member 187 second sealing member 188 into a chamber coupling member 126. The chamber coupling member may comprise a first intake port 141, a first retaining ring 161, a drain passage 134, first exhaust port, a first exhaust port 143, a first floor 181, a proximal bore 128, a second retaining ring 162, the first and second sealing members, 187 and 188 are first assembled with the elastomeric first and second more engagement member 187*e*, 188*e* disposed within first and second shaft engagement member cavities 187*c*, where the elastomeric first and second more engagement member 187*e*, protrudes at least partially past the cavities 187*c*.

The first and second sealing members, 187 and 188 may be inserted within the chamber coupling member 126 distally from the proximal bore 128 and towards and the distal bore 130 with the registration feature aligned with a corresponding registration feature formed within the chamber coupling member 126. Thereafter the fixed shaft member 118 may be inserted distally from the proximal bore 128 and towards and the distal bore 130 and the outside surface 118*o* of the fixed shaft member 118 radially compresses the elastomeric first and second bore engagement member 187*e*, 188*e* within the proximal bore 128 and towards and the distal bore 130 and effectively creating an air tight and water tight seal between the outside surface of the fixed shaft member 118 and the proximal bore 128 and the distal bore 130.

The chamber coupling member 126 and the fixed shaft member 118 may be designed such that there exists a relatively tight fit for vapor or aerosol and air sealing between the first and second sealing members, 187 and 188, the chamber coupling member 126 and the fixed shaft member 118, with the fit being sufficiently loose to allow rotation of the chamber coupling member 126 about an axis of the fixed shaft member 118*x*. A portion of the first and second sealing members, 187 and 188, may be compressible and manufactured from the elastomeric material. The first and second shaft engagement member may be manufactured from a hard-thermoplastic material such as POM or nylon or polytetrafluoroethylene.

Referring to FIG. 2G, in addition to the first and second sealing members, 187 and 188, first and second rotatory shaft seals, 187*r* and 188*r*, may also be provided for frictionally engaging of the fixed shaft member 118 as well as the bores of the chamber coupling member when the first and second sealing members and the rotatory shaft seals, 187*r* and 188*r*, are inserted into the bores of the chamber coupling member 126.

FIGS. 1E, 1F, 1H, and 1*i* illustrate the fixed shaft member 118 and the first and second shaft engagement member 187*s*, 188*s* in the first orientation 1001 and FIG. 1G illustrates the fixed shaft member 118, a proximal end 118*a*, an inlet opening 118*i*, a second sealing member 188, a distal end 118*e*, a stop member 118*b*, a first exhaust port 187*e*, a first intake port 187*i*, a first sealing member 187, a keyseat 490, and a proximal plug 173, and the first shaft engagement member 187*s* and second shaft engagement member 188*s* in an in-between orientation, such as a third position 1003, where the rotatable water filtration assembly 1100 may be oriented about perpendicular with gravity in orientation in the third position 1003.

Referring to FIGS. 1*i* and 2C and 3A, the chamber coupling member 126 may have formed therein intake ports and exhaust ports, the chamber coupling member 126 may include a chamber coupling member first intake port 141 formed between the first floor 181 and the proximal bore 128 and a chamber coupling member first exhaust port 143 formed between the first floor 181 and the distal bore 130 and it may include a chamber coupling member second intake port 142 formed between the second floor 182 and the proximal bore 128 and a chamber coupling member second exhaust port 144 formed between the second floor 182 and the distal bore 130. A division between the proximal bore and the distal more may be proximate the stop member 118*b*. An inner diameter of the proximal bore proximate the registration feature of the chamber coupling member 126 may be larger than an inner diameter of the distal bore. The first and second sealing members, 187 and 188 may also have corresponding first and second intake 187*i*, 188*i* and first and second exhaust ports, 187*e* and 188*e*.

The chamber coupling member first intake port 141 and chamber coupling member first exhaust port 143 may be fluidly aligned with the first sealing members 187 first intake port 187*i* and the first exhaust ports 187*e* and the chamber coupling member second intake port 142 and chamber coupling member second exhaust port 144 may be fluidly aligned with the second sealing members 188 second intake port 188*i* and the second exhaust ports 188*e* when the first and second sealing members are inserted within the bores of the chamber coupling member 126.

Releasably secured to fixed shaft member distal end 118*e* there may be the mouthpiece assembly 146 for dispersing exhausted vapor or air or smoke from the water filtration apparatus 100, where the second elastomeric sealing rings 172 disposed proximate the distal end 118*e* are for fluidly and frictionally releasably coupling of the mouthpiece assembly 146 to the fixed shaft member distal end 118*e*. A mouthpiece tip may be provided 146*t*.

Figure 3B:
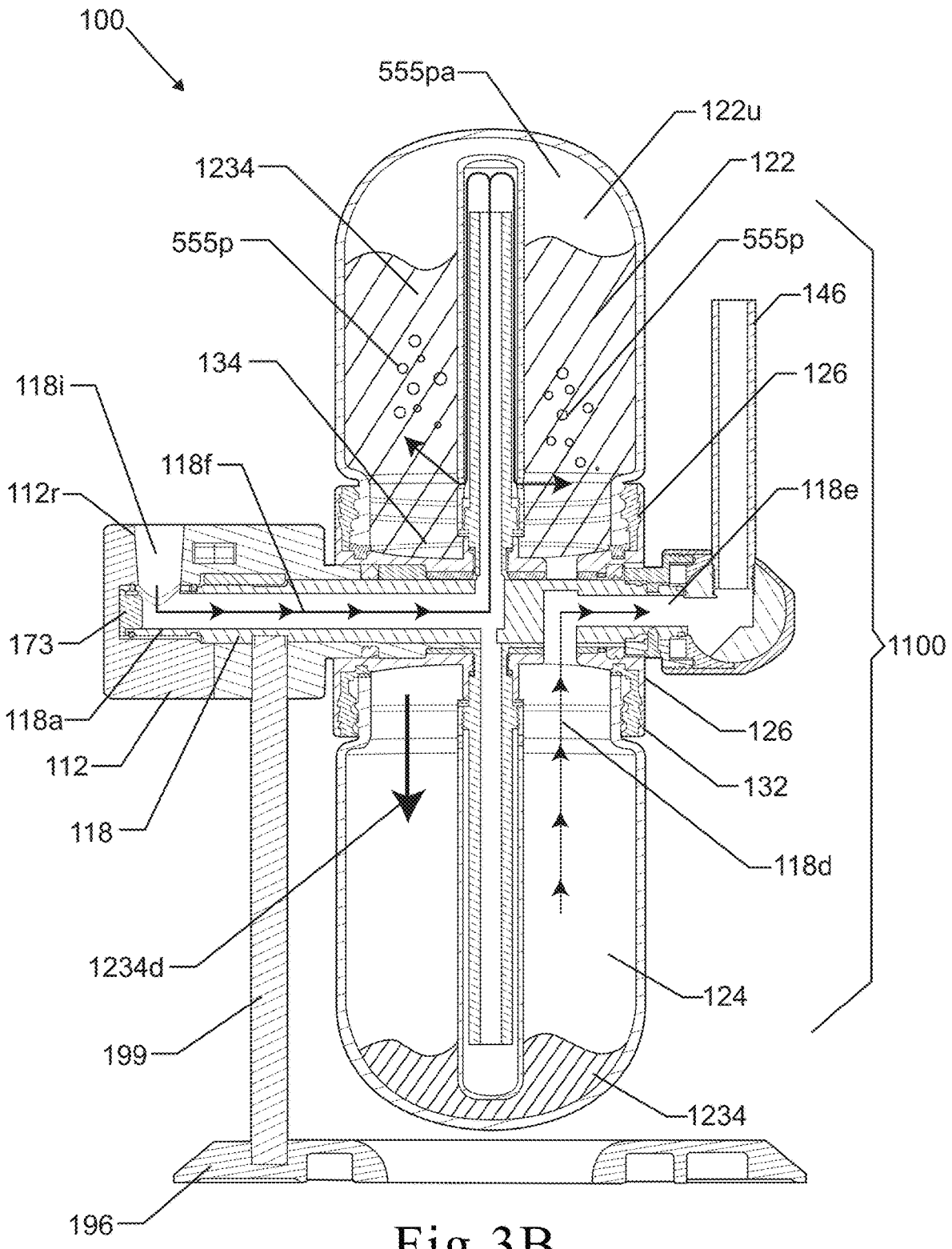
FIG. 3B illustrates a volume of liquid gravitating through a drain passage under an influence of gravity.
Figure 3C:
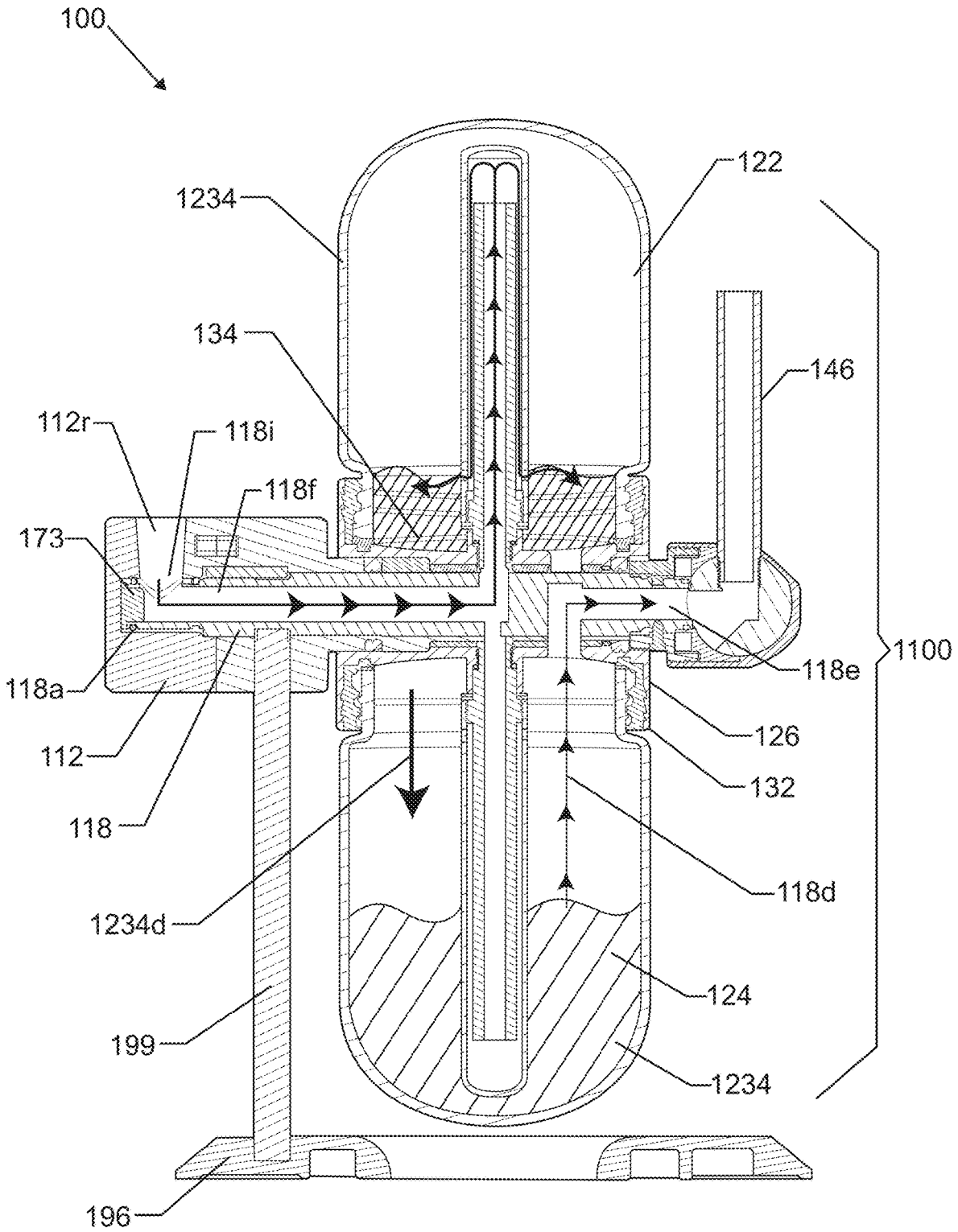
FIG. 3C illustrates a illustrates a volume of liquid gravitating through a drain passage under an influence of gravity.
Figure 3D:
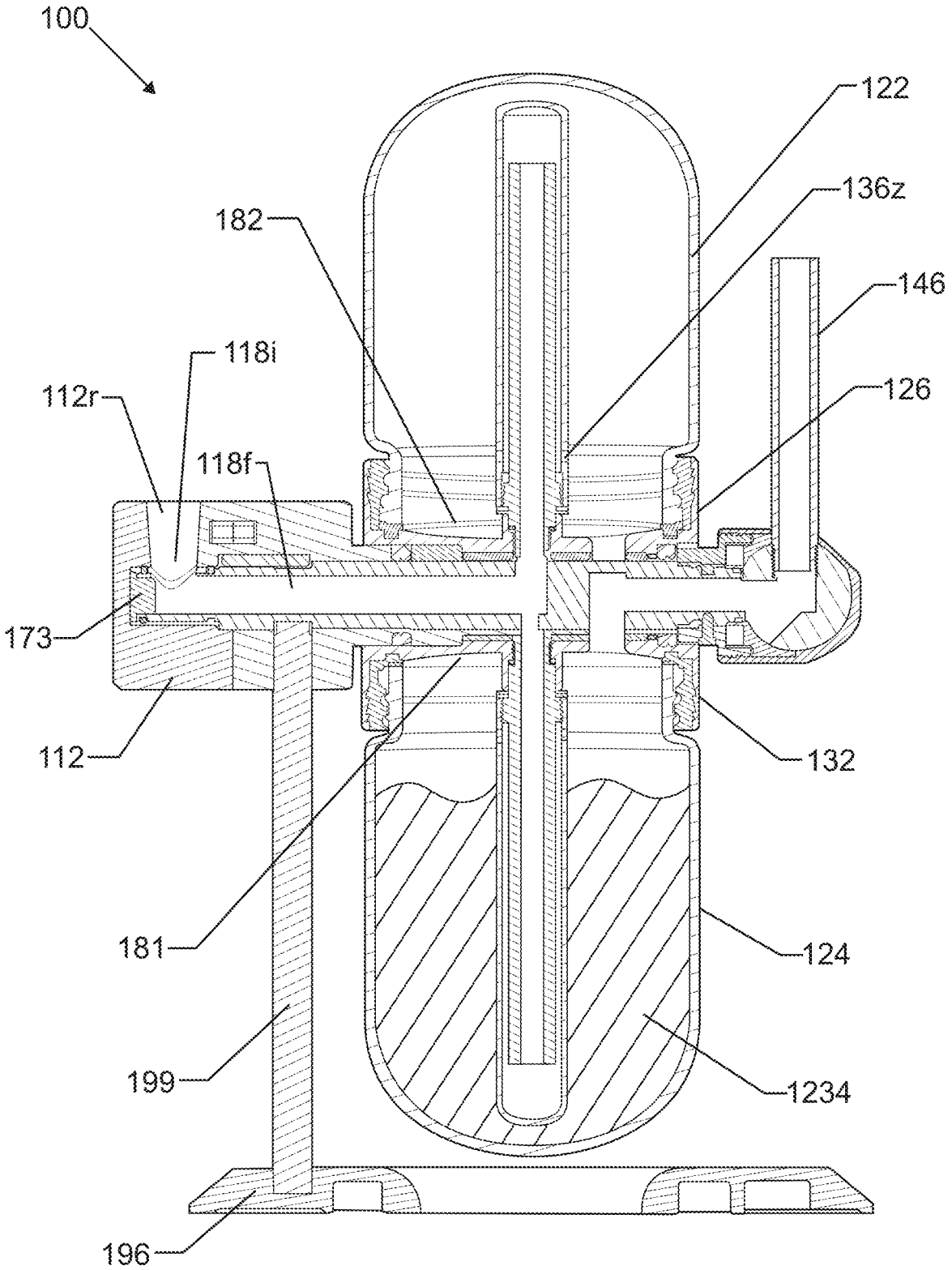
FIG. 3D illustrates a volume of liquid having fully gravitated between a first chamber and a second chamber.

Referring to FIG. 3D, generally when filling of a liquid, such as water 1234 into the rotatable water filtration apparatus 1200, the rotatable water filtration assembly 1100 may be oriented in the first position 1001, as shown in FIG. 1B, with the first chamber 122 may be removed from the chamber coupling member 126 and the second chamber 124 remains secured with the chamber coupling member 126 and water may be poured from the first floor 181 side to flow and gravitate through drain passage 134, as shown in FIG. 2C and FIG. 2D, a chamber coupling member 126 may comprise a first floor 181, a distal bore 130, a chamber coupling member outer surface 132, a drain passage 134, a first conduit 136, a second 138, a first floor 181, a second floor 182, a second coupling area 124*a*, a first chamber 122, a second coupling area 122*a*, to the second chamber 124. For removing water 1234 from the rotatable water filtration apparatus 1200, for example the rotatable water filtration assembly 1100 may be oriented in the first position 1001 with the first chamber 122 may be removed from the chamber coupling member 126 and the second chamber 124 remains secured with the chamber coupling member 126 and the rotatable water filtration assembly 1100 may be oriented into the second position and water flow from the second chamber 124 through the through drain passage 134 and out from the second chamber 124 under a gravitational influence. A volume of water may be filled into the second chamber 124 may be about 60% to 80% of a capacity of the second chamber 124.

Referring to FIGS. 3A, 3B, 3C and 3D, the rotatable water filtration apparatus 100 is illustrated and use thereof is explained. A rotatable water filtration apparatus 100 may comprise an outer ends 122*b*, a first chamber 122, water 1234, a first upper area 122*u*, first conduit outlet port 136*z*, a mouthpiece assembly 146, a distal end 118*e*, an exhaust opening 118*d*, a chamber coupling member may comprise a first intake port 141, a chamber coupling member 126, a first exhaust port 143, a second exhaust port 144, a second intake port 142, a chamber coupling member outer surface 132, a second chamber 124, a base assembly 196, a downwardly flowing volume of liquid 1234*d*, a fixed shaft member 118, a proximal end 118*a*, a stand assembly 199, a proximal bore 128, a key 492, a downstem assembly 112, a proximal plug 173, a inlet opening 118*i*, a downstem assembly receiving port 112*r*, a shaft member first fluid pathway 118*f*, a drain passage 134, percolated air 555, first floor 181, and a first conduit inlet port 136*a*. A rotatable water filtration assembly 1100 may be a combination of a first chamber 122, outer end 122*b*, first outer wall structure 122*w*, a first coupling area 122*a*, a second coupling area 124*a*, a second chamber 124, a second outer wall structure 124*w*, an outer end 124*b*.

Referring to FIG. 1*i* and FIG. 3A, the first conduit inlet port 136*a* may be coupled with the chamber coupling member first intake port 141 and the second conduit inlet port 138*a* may be coupled with the chamber coupling member second intake port 142 and first and second retaining rings, 161 and 162. The first retaining ring 161 may be frictionally engaged with the chamber coupling member 126 on an inside surface of the chamber coupling member 126 proximate the first floor 181 where the first retaining ring 161 may be recessed within the chamber coupling member 126 and for engaging of the first chamber proximate its first coupling area 122*a*, where this may be a threaded or magnetic or frictional engagement and preferably this embodiment may be water and air tight.

The second retaining ring 162 may be frictionally engaged with the chamber coupling member 126 on an inside surface of the chamber coupling member 126 proximate the second floor 182 where the second retaining ring 162 may be recessed within the chamber coupling member 126 and for engaging of the second chamber proximate its second coupling area 124*a*, where this may be a threaded or magnetic or frictional engagement and preferably this enablement may be water and air tight.

Specifically, with reference to FIG. 3A, a volume of liquid 1234, after an approximately half a full revolution of the rotatable water filtration assembly 1100 about the longitudinal axis of the fixed shaft member 118, the water 1234 or liquid first assumes a generally top elevated position within one of the first chamber 122 and the second chamber 124. In this embodiment, it may be the first chamber 122. Once this half-turn rotation has occurred, it may be observed that the liquid or water 1234 may be now positioned above the fixed shaft member 118 and includes potential energy.

Referring to FIGS. 3B and 3C, the volume of liquid 1234 gravitates through the drain passage 134 to the other of the other of the first chamber 122 and the second chamber 124 and in this embodiment to the second chamber 124 due to the influence of gravity. A rotatable water filtration assembly 1100 may be a combination of a first chamber 122, outer end 122*b*, first outer wall structure 122*w*, a first coupling area 122*a*, a second coupling area 124*a*, a second chamber 124, a second outer wall structure 124*w*, an outer end 124*b*. FIG. 3D illustrates the volume of liquid 1234 having fully gravitated towards the other of the other of the first chamber 122 and the second chamber 124.

The movement of the liquid 1234 from the top elevated position within the one of the first chamber 122 and the second chamber 124 and in this case the first chamber 122 to the lower of the other of the first chamber 122 and the second chamber 124 and in this case the second chamber 124 results in a suction area about a first upper portion 122*u* of the first chamber 122 this induces air to flow from the downstem assembly 112 as downstem flow 112*f* and through the shaft member first fluid pathway 118*f* from the inlet opening 118*i* to the first fluid pathway outlet opening 118*c* and to the chamber coupling member first intake port 141 and further to the first conduit inlet port 136*a* with induced air flow through the first reversing air path 136*p* when the shaft member first fluid pathway 118*f* may be fluidly coupled with the first reversing air path 136*p*.

As shown in FIG. 3B, air coming out from the first reversing air path 136*p* proximate the first conduit outlet port 136*z* may be percolated air 555*p* upwardly through the volume of liquid 1234 downwardly flowing volume of liquid 1234*d* through the drain passage 134 and for the percolated air 555*pa* to gather into the first upper area 122*u* of the first chamber 122.

The downward movement of the downwardly flowing volume of liquid 1234*d* may force air disposed in the other of the first chamber 122 and the second chamber 124, and in this case the second chamber 124, that was received therein during the previous revolution of the rotatable water filtration assembly 100, through the exhaust opening 118*d* with an aligned chamber coupling member second exhaust port 144 formed within the second floor and fluidly coupled with the shaft member second fluid pathway 118*g* such that during each half revolution of the rotatable water filtration assembly 1100 a volume of air may be received within the one of the first chamber 122 and the second chamber 124 and the previous volume of air received during the preceding half revolution it exhausted from the other of the first chamber 122 and the second chamber 124 as the rotatable water filtration assembly 1100 may be rotated between approximately the first and second orientations.

In the orientations between approximately the first and second orientations, for example 15 degrees from the first orientation, the first fluid pathway outlet opening 118*c* may be other than fluidly coupled with the chamber coupling member first intake port 141 and the chamber coupling member second intake port 142 and the first conduit inlet port 136*a* and the second conduit inlet port 138*a*. As well the exhaust opening 118*d* may be other than fluidly aligned with the chamber coupling member second exhaust port 144 and the chamber coupling member first exhaust port 143.

The above process may be repeatable in a similar manner when the second chamber 124 or oriented gravitationally above the first chamber 122. It may be therefore appreciated that each half cycle or half turn of the rotatable water filtration assembly 100 causes air or vapor or smoke to be drawn into the upper vacuum area of an upper oriented chamber and at the same time results in air or vapor or smoke disposed in a lower oriented chamber to be exhausted. Consequently, one revolution (from the first orientation to the first orientation, for example) of the rotatable water filtration assembly 100 results in air or vapor or smoke being drawn within a particular chamber during the first half cycle or half turn and that the same causes air or vapor or smoke to being exhausted from the same chamber during the second half turn or half cycle.

Figure 4A:
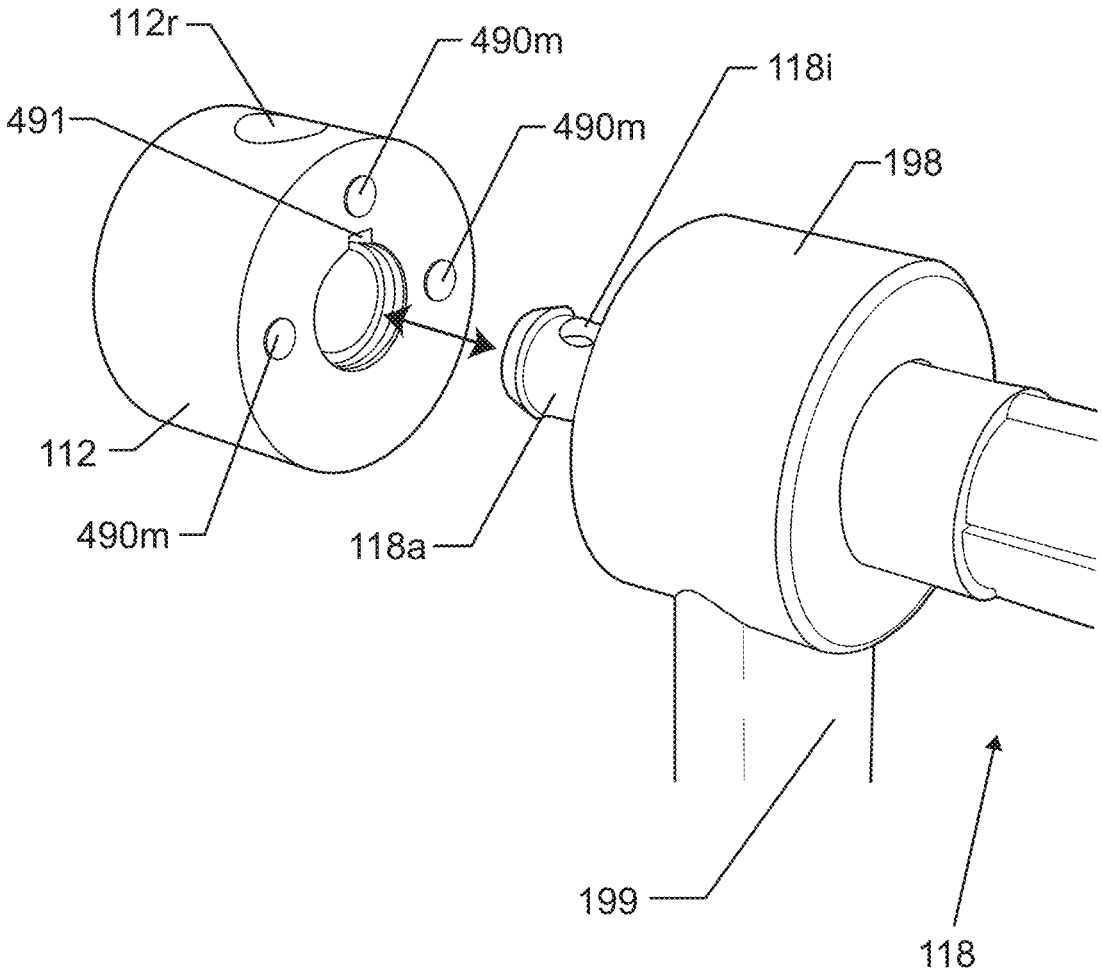
FIG. 4A illustrates a perspective view of a portion of a stand assembly and a stand collar and showing at least a keyway.
Figure 4B:
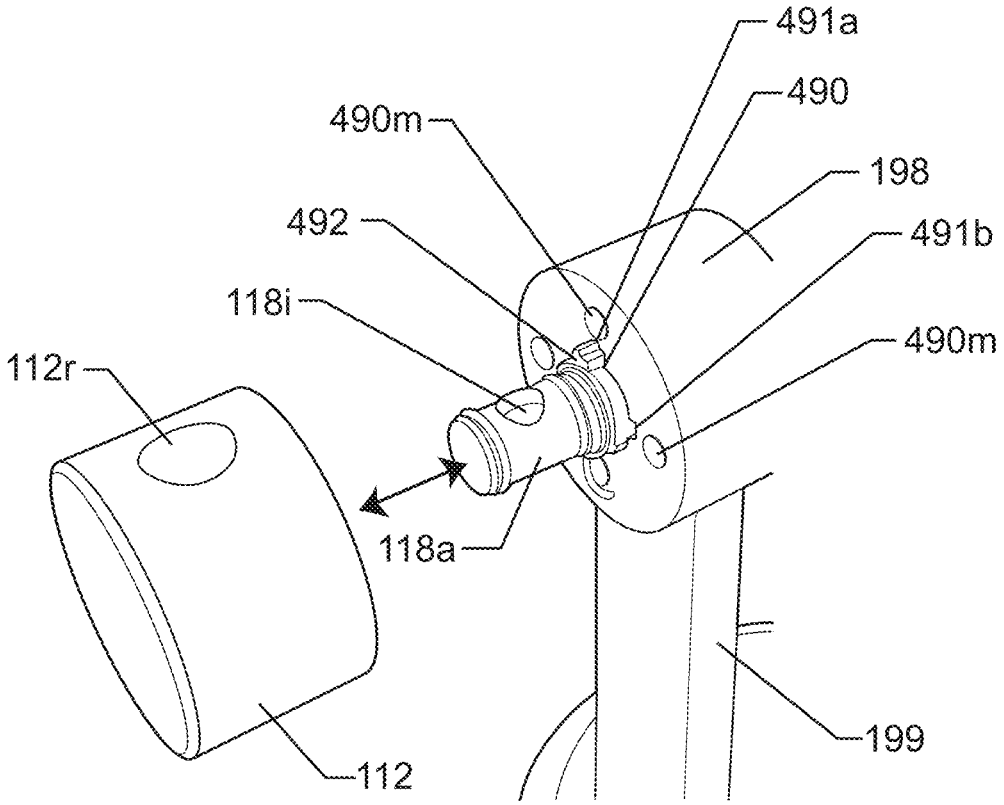
FIG. 4B illustrates a perspective view of a portion of a stand assembly and a stand collar and showing at least a keyway and a detachable downstem assembly.

FIGS. 4A and 4B illustrates a portion of the stand assembly 199 and the stand collar 198 comprising a downstem assembly 112, a keyway 491, a first keyway 491*a*, a second keyway 491*b*, a downstem assembly receiving port 112*r*, magnets 490*m*, a proximal end 118*a*, an inlet opening 118*i*, a stand collar 198, a fixed shaft member 118, and a stand assembly 199, where at least a keyway 491*b* may be formed within the stand collar 198 and the fixed shaft member 118 having a keyseat 490, a key 492 may disposed within the least a keyway 491*b* and the keyseat 490, the key 492 may be for preventing rotation of the fixed shaft member 118 in relation to the stand assembly 199.

Furthermore, the key may 492 may be for orienting of the fixed shaft member 118 within the stand collar 198 in at least one of two positions with respect to a longitudinal axis of the. Wherein the at least a keyway formed within the stand collar 198 comprises a first keyway 491*a* and a second keyway 491*b* and wherein the first and second keyway are about ninety degrees circumferentially separated from each other about the fixed shaft member 118 longitudinal axis 118*x* (FIG. 5D) wherein the at least a keyway may be for orienting of the fixed shaft member 118 with respect to the stand assembly 199, where this may facilitate the stand assembly 199 and coupled stand base 199*a* to rest against a surface that may be parallel with gravity or to be oriented with respect to a surface may be approximately perpendicular to gravity, such as a wall.

Figure 4C:
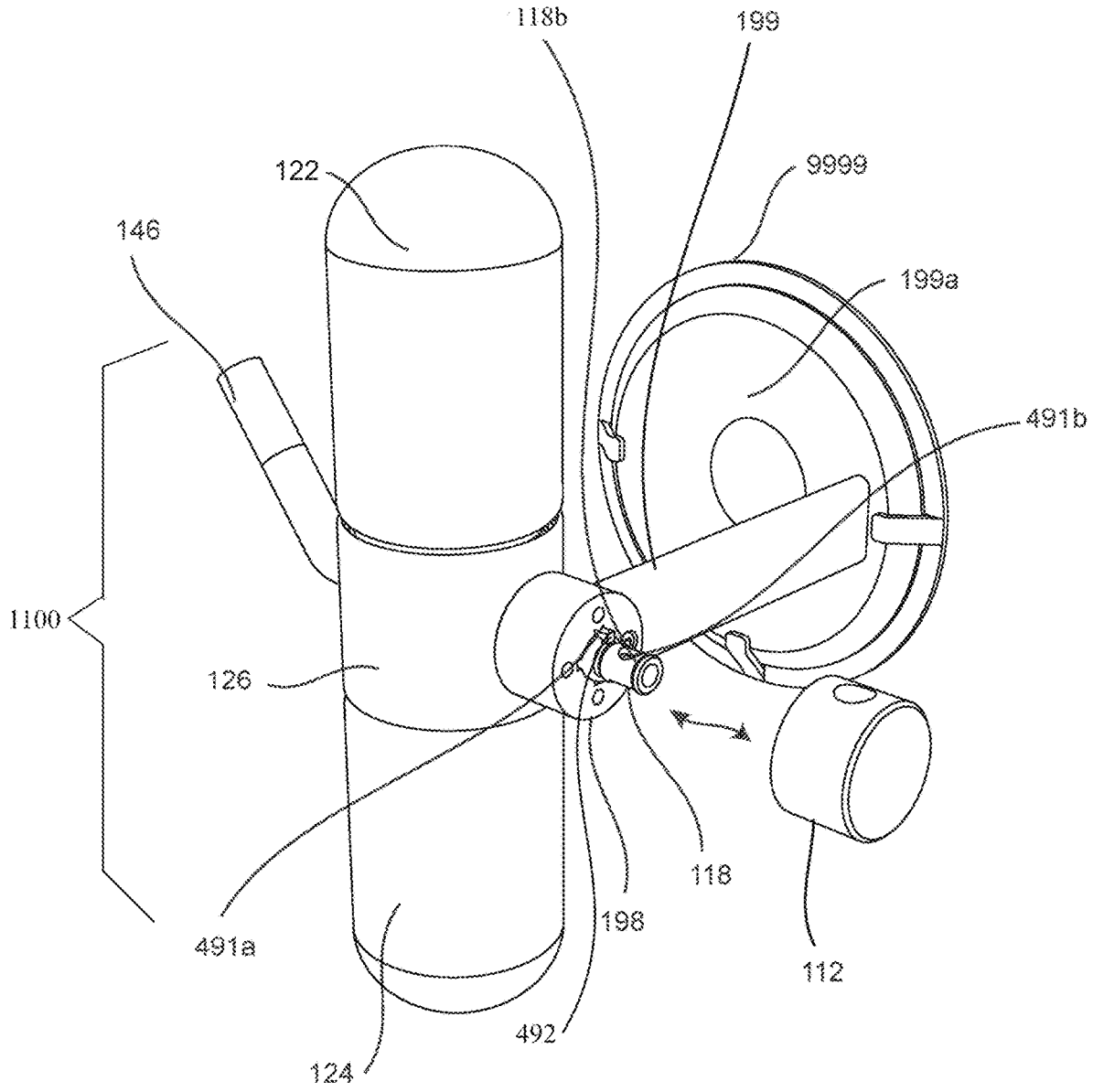
FIG. 4C illustrates a water filtration apparatus from an end view and frictionally engaged with a wall mount fixedly attached with a vertical surface.

FIG. 4C illustrates a water filtration apparatus from an end view and frictionally engaged with a wall mount fixedly attached with a vertical surface. The water filtration apparatus as shown in FIG. 4C may comprise a mouthpiece assembly 146, a first chamber 122, a stop member 118*b*, a stand assembly 199, stand base 199*a*, wall mount 9999, a second keyway 491*b*, a downstem assembly 112, a fixed shaft member 118, a stand collar 198, a key 492, a second chamber 124, first keyway 491*a*, and a chamber coupling member 126. A rotatable water filtration assembly 1100 may be a combination of a first chamber 122, a second chamber 124, and a chamber coupling member 126. For having the rotatable water filtration apparatus 100 floor positioned or table positioned, then the first keyway 491*a* may be used for supporting the key 492 with the keyseat 490 and for wall mounting as is shown in FIG. 4C, the second keyway 491*b* may be used for supporting the key 492 with the keyseat 490. A wall mount 9999 may be provided for releasably coupling of the stand base 199*a* with a firstly a wall mount 9999 fixedly attached with a vertical wall surface and thereafter the stand base 199*a* may frictionally slide within the wall mount 9999 fixedly attached with the vertical wall surface.

Figure 4D:
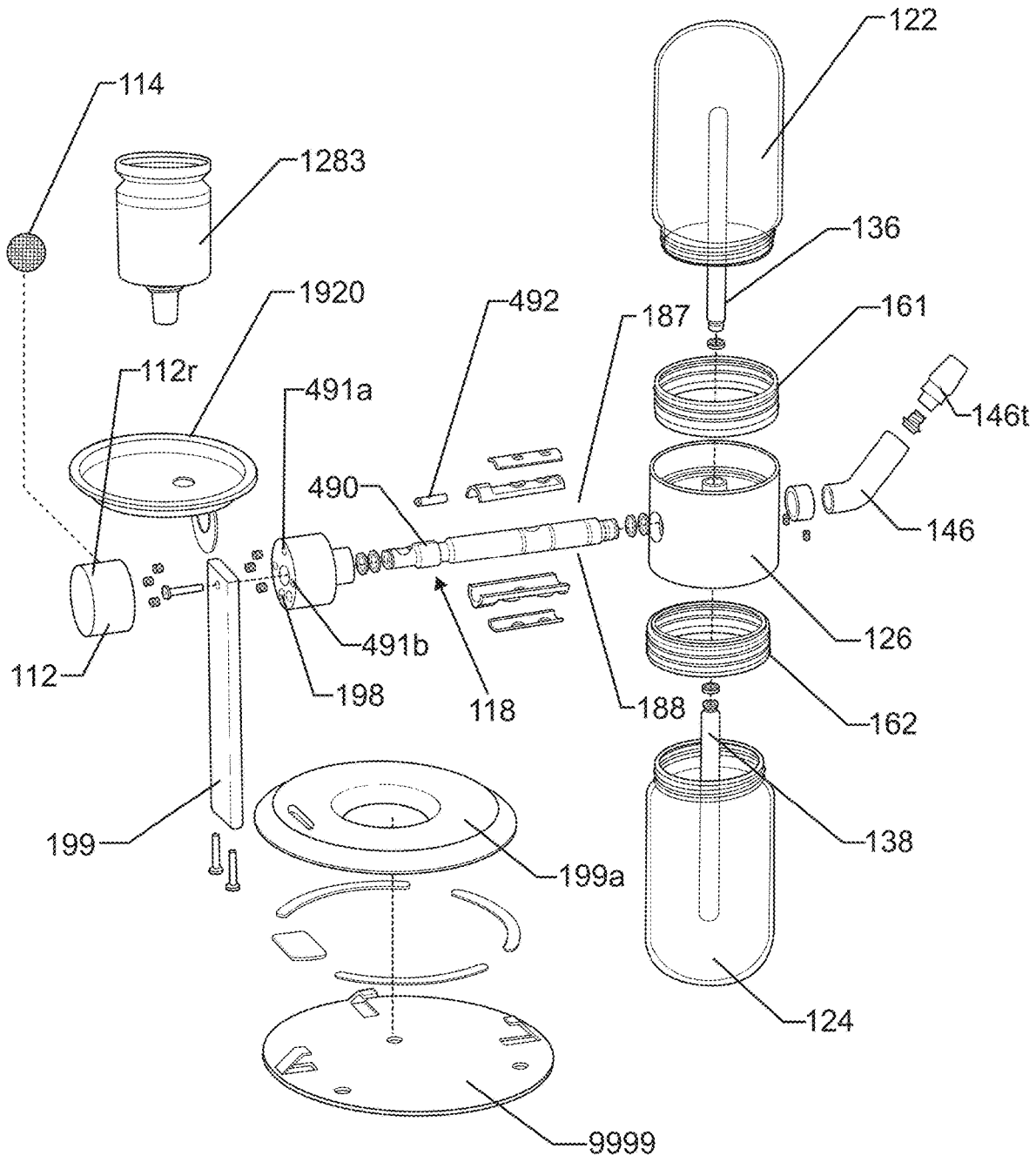
FIG. 4D illustrates an exploded view of the water filtration apparatus in accordance with a first embodiment of the invention.

FIG. 4D illustrates an exploded view of the rotatable water filtration apparatus 100, which may comprise a screen 114, downstem assembly 112, downstem assembly receiving port 112*r*, a bowl 1283, a tray 1920, a first keyway 491*a*, a second keyway 491*b*, a stand collar 198, a keyseat 490, a key 492, a fixed shaft member 118, a first sealing member 187, a second sealing member 188, a first chamber 122, a first conduit 136, a first retaining ring 161, a mouthpiece tip 146*t*, a mouthpiece assembly 146, a chamber coupling member 126, a second retaining ring 162, a second conduit 138, a second chamber 124, a wall mount 9999, a stand base 199*a*, and a stand assembly 199. The tray 1920 is optional and may be provided for being releasably coupled proximate the downstem assembly 112 and the stand collar 198 furthermore, frictional pads or rubber feet maybe provided to frictionally engage the stand base 199*a* with a horizontal surface, such as the table, and prevent sliding of the stand base 199*a* when rotating of the rotatable water filtration assembly 1100 rotatively mounted about said fixed shaft member 118. Magnets 490*m* may be provided for releasably coupling of the downstem assembly 112 from the stand collar 198. Releasably coupled may facilitate cleaning as required after multiple uses.

The downstem assembly 112 maybe for receiving or for holding or supporting phyto material to be combusted or for holding a vaporization assembly. A screen 114 may be secured transversely across a lower portion of the downstem assembly 112 within the downstem assembly receiving port 112*r*, which may be for receiving of the phyto material. A bowl 1283 may also be used. In some embodiments, the bowl 1283 may include a lid assembly for holding hot coals and for contacting phyto material disposed within the bowl 1283.

Figure 5A:
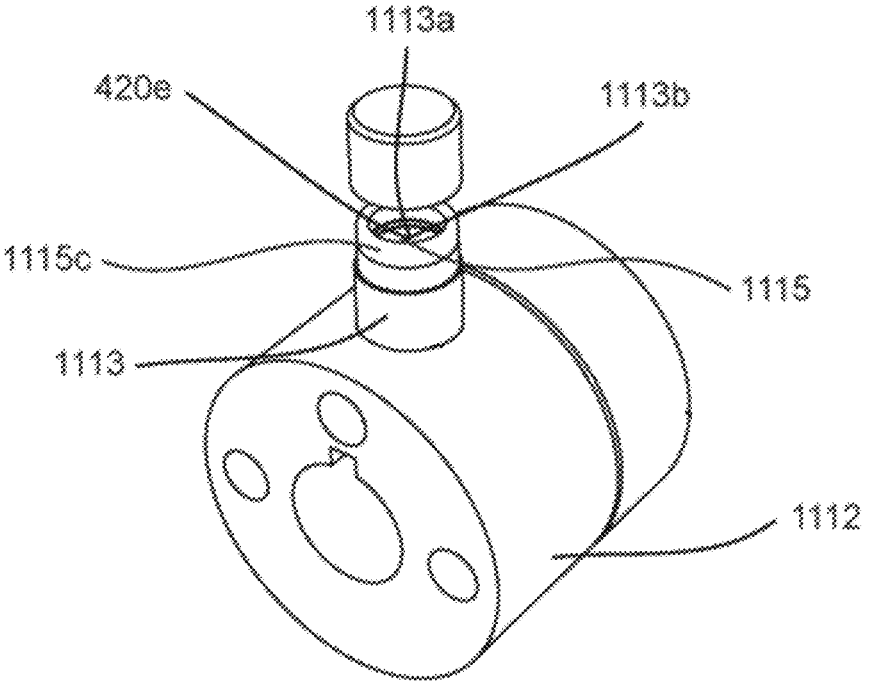
FIG. 5A illustrates a downstem assembly that includes an aerosol generating system.
Figure 5B:
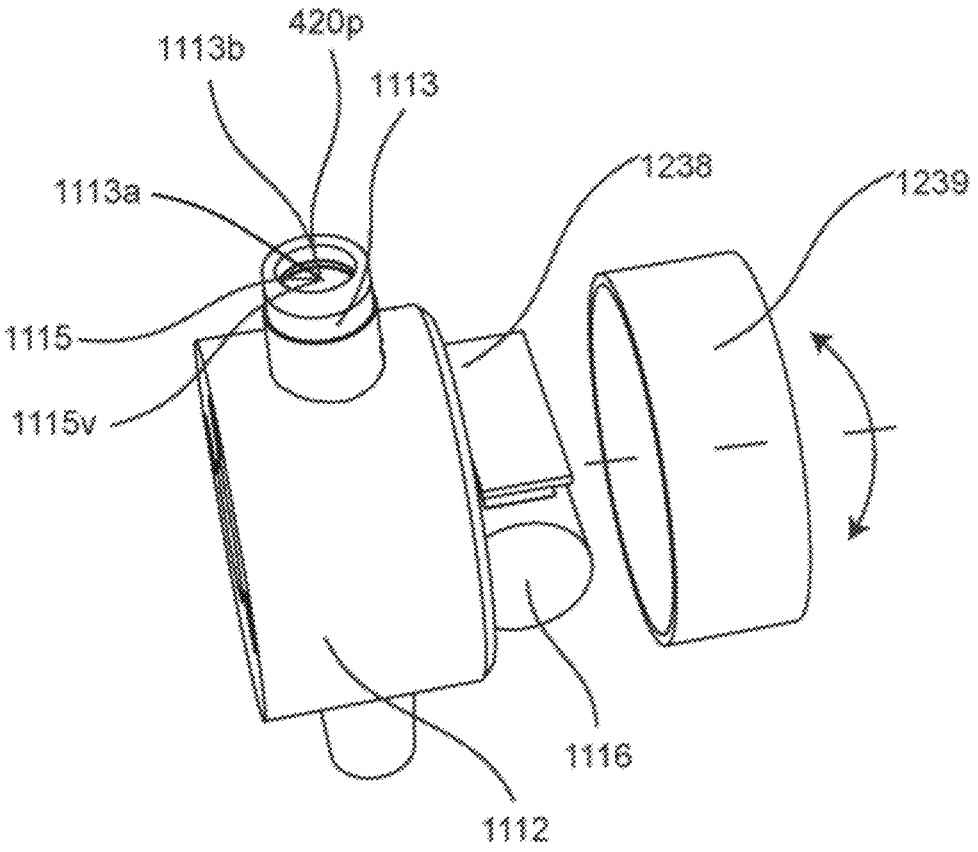
FIG. 5B illustrates a downstem assembly that includes an aerosol generating system and showing a user interface.

Referring to FIGS. 5A and 5B, a downstem assembly 1112 may be provided that comprises an aerosol generating system 1113 or in some embodiments an atomizer assembly wherein the aerosol generating system comprises a phyto material received area 1113*b* for receiving of a phyto material through an access opening 1113*a* and for heating of the phyto material disposed proximate the receiving port 112*r* for when heated to a predetermined temperature for generating at least some aerosol from the heating of the phyto material where the movement of the volume of liquid 1234 from the top elevated position within the one of the first chamber 122 and second chamber 124 to the lower of the other of the first chamber 122 and second chamber 124 results in a suction area about a lower portion of the one of the first chamber and second chamber and this induces at least one of air and the least some aerosol to flow from the downstem assembly 1112 and through the shaft member first fluid pathway 118*f* and results in the at least one of air and the at least some aerosol to percolate upwardly through the volume of liquid downwardly flowing through the drain passage and for the percolated at least one of air and the at least some aerosol to gather into an upper area of the one of the first chamber and second chamber, where the downward movement of the liquid forces the at least one of air and the at least some aerosol disposed in the other of the first chamber and second chamber, that was received therein during the previous revolution of the rotatable water filtration assembly 1100, through an exhaust opening 118*d* fluidly connected with the shaft member second fluid pathway 118*g*, such that during each at least half revolution of the rotatable water filtration assembly 1100 a volume of the at least one of air and the at least some aerosol may be received within the one of the first chamber and second chamber and the previous volume of the at least one of air and the at least some aerosol received during the preceding revolution it exhausted from the other of the one of the first chamber and second chamber from the mouthpiece assembly 146. In some embodiments, a flow rate through the drain passage may be adjustable using a selectable flow restrictor.

The aerosol generating system may a heating element assembly 11115 for controllably receiving of electrical energy from an electrical energy storage source 1116 and for heating of the phyto material proximate the heating element assembly to the predetermined temperature for creating of the at least some aerosol. The aerosol generating system may also include an OLED display 1238 or a visual display such as an LED display and a user interface 1239, for example a functional dial that may be transparent or translucent and mounted to rotate along an axis of the aerosol generating system so that the user may select their temperature and also control unit operation. Buttons are also envisaged as a tactile form of the user interface 1239.

The heating element assembly 1115 for controllably receiving of electrical energy from the electrical energy storage source 1116 and for conductive heating of a phyto material extract 420*e* disposed proximate the heating element assembly to the predetermined temperature for creating of the at least some aerosol where the predetermined temperature may be between 500 and 700 degrees Fahrenheit.

A conductive heating element assembly 1115*c* for controllably receiving of electrical energy from an electrical energy storage source and for conductive heating of a phyto material leaf disposed proximate the heating element assembly to the predetermined temperature for creating of the at least some aerosol and where the predetermined temperature may be between 350 and 450 degrees Fahrenheit, FIG. 5A.

A convective heating element assembly 1115*v* for controllably receiving of electrical energy from an electrical energy storage source and for convective heating of a phyto material leaf 420*p* disposed proximate the heating element assembly to the predetermined temperature for creating of the at least some aerosol and where the predetermined temperature may be between 350 and 450 degrees Fahrenheit, FIG. 5B.

In some embodiments, material to be combusted may be disposed proximate the downstem assembly 112 within the bowl 1283 (FIG. 1A) fluidly coupled with the downstem assembly 112 for generating a combustion aerosol. This combustion aerosol may result from leaf phyto material being heated to a combustion temperature, or in some cases may be heated with hot coals, such as when the rotatable water filtration apparatus 100 may be used as a tobacco shisha.

The heating element assembly heating of the phyto material or the phyto material extract to the predetermined temperature for creating of the at least some aerosol and where the at least some aerosol may be for propagating through the first shaft member first fluid pathway 118*f* and further through the chambers to the mouthpiece assembly 146 using the aforementioned processes.

Figure 5C:
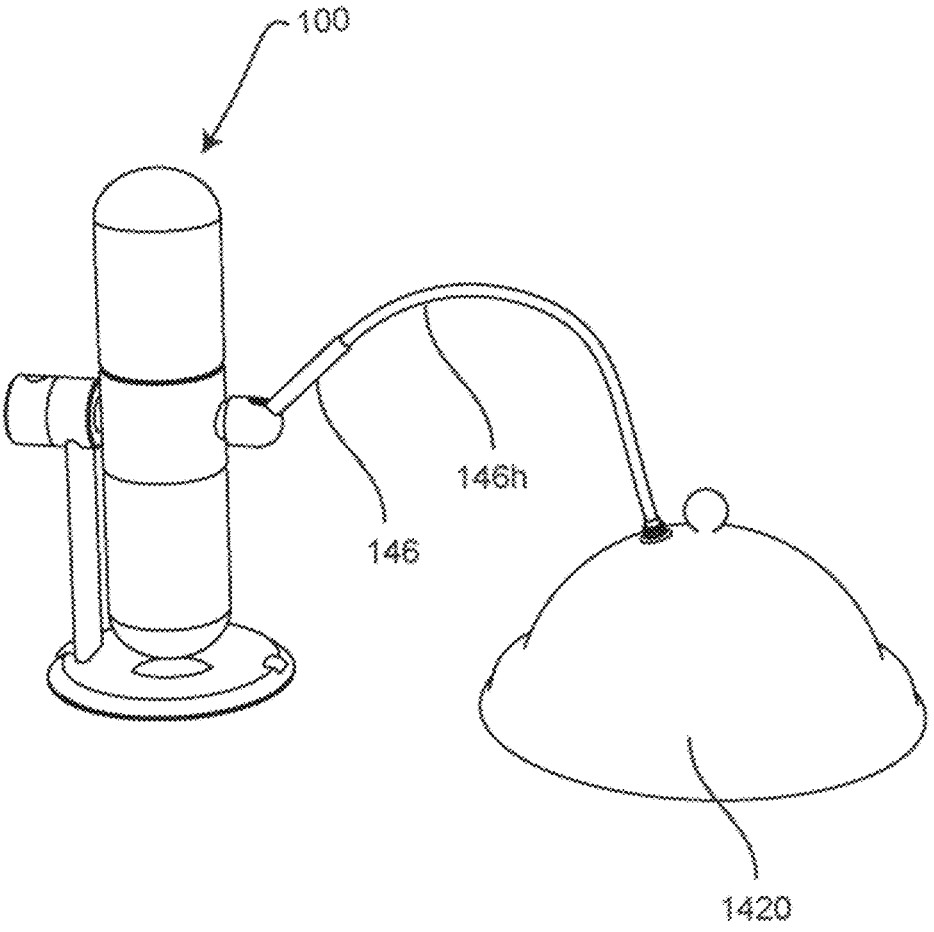
FIG. 5C illustrates a water filtration apparatus in accordance with a first embodiment of the invention fluidly coupled with a smoking cloche.

FIG. 5C illustrates the rotatable water filtration apparatus 100 in accordance with the first embodiment of the invention with the mouthpiece assembly 146 fluidly coupled with a smoking cloche 1420 through the use of a mouthpiece hose assembly 146*h*. The mouthpiece hose assembly 146*h* may be magnetically or frictionally coupled with the mouthpiece assembly 146 as well as with the smoking cloche 1420. The mouthpiece hose assembly 146*h* may fluidly couple the second fluid pathway 118 with an inner volume of the smoking cloche 1420. Aerosol generated by the rotatable water filtration apparatus 100 may enter the smoking cloche 1420 and the aerosol may be used to impart flavorings to items contained within the inner volume of the smoking cloche 1420.

Figures 5D, 5E, 5F, 5G:
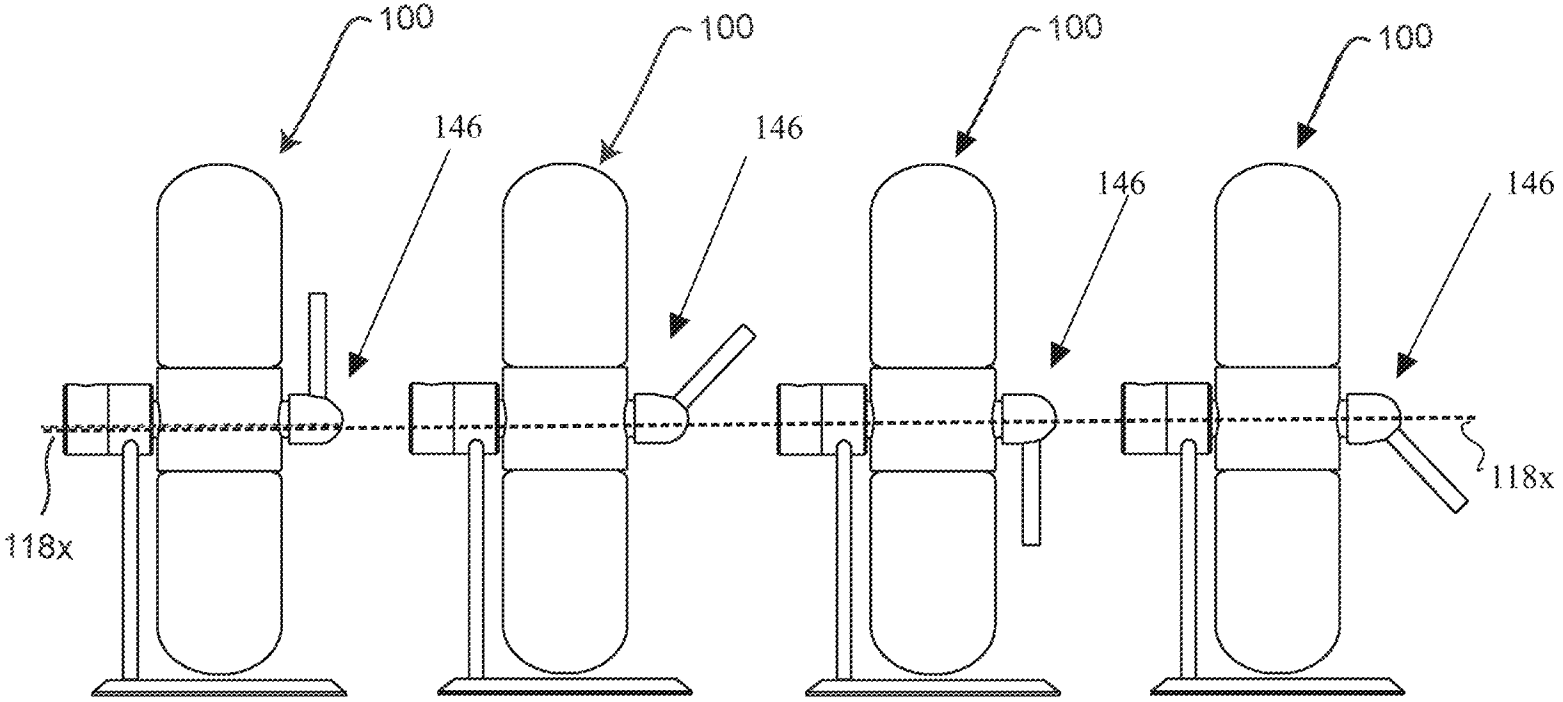
FIG. 5D illustrates a mouthpiece assembly being rotatable about a longitudinal axis of a fixed shaft member.
FIG. 5E illustrates a mouthpiece assembly may oriented at upward and at an angle of 45 degrees with a fixed shaft member.
FIG. 5F illustrates a mouthpiece assembly being rotatable about a longitudinal axis of a fixed shaft member and may be oriented approximately perpendicular and downward with the fixed shaft member.
FIG. 5G illustrates a mouthpiece assembly oriented downward and at an angle of 45 degrees with a fixed shaft member.

FIG. 5D illustrates the mouthpiece assembly 146 being rotatable about the longitudinal axis of the fixed shaft member 118*x*, wherein the mouthpiece assembly 146 may be oriented approximately perpendicular and upward with the fixed shaft member 118*x*. Referring to FIG. 5E, the mouthpiece assembly 146 may be oriented at upward and at an angle of 45 degrees with the fixed shaft member 118*x*. Referring to FIG. 5F, the mouthpiece assembly 146 being rotatable about the longitudinal axis of the fixed shaft member 118*x*, wherein the mouthpiece assembly 146 may be oriented approximately perpendicular and downward with the fixed shaft member 118*x*. Referring to FIG. 5G, the mouthpiece assembly 146 may be oriented downward and at an angle of 45 degrees with the fixed shaft member 118*x*.

Figure 6A:
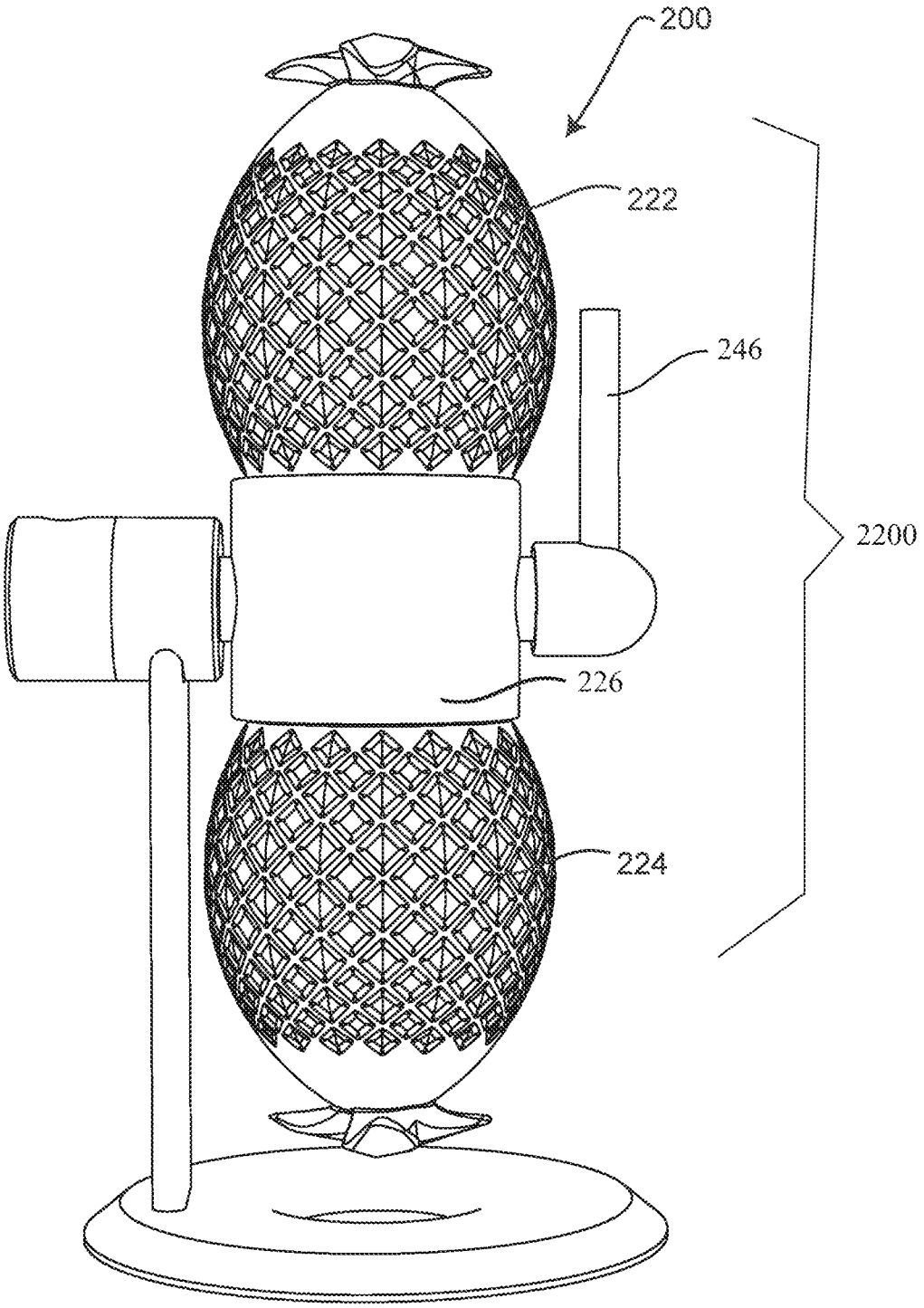
FIG. 6A illustrates a rotatable water filtration assembly in accordance with a second embodiment of the invention.

FIG. 6A illustrates a rotatable water filtration assembly 200 in accordance with a second embodiment of the invention. The rotatable water filtration assembly 200 may comprise a first chamber 222, a second chamber 224, a mouthpiece assembly 246, and a chamber coupling member 226. A rotatable water filtration assembly 2200 may be a combination of a first chamber 222, a second chamber 224, and a coupling member 226. A first chamber 222 and a second chamber 224 may be about opposite sides of the chamber coupling member 226. The first chamber 222 and second chamber 224 are preferably transparent and may be translucent and may be colored and may be constructed of shaped glass, such as a shape resembling a pineapple.

Figure 6B:
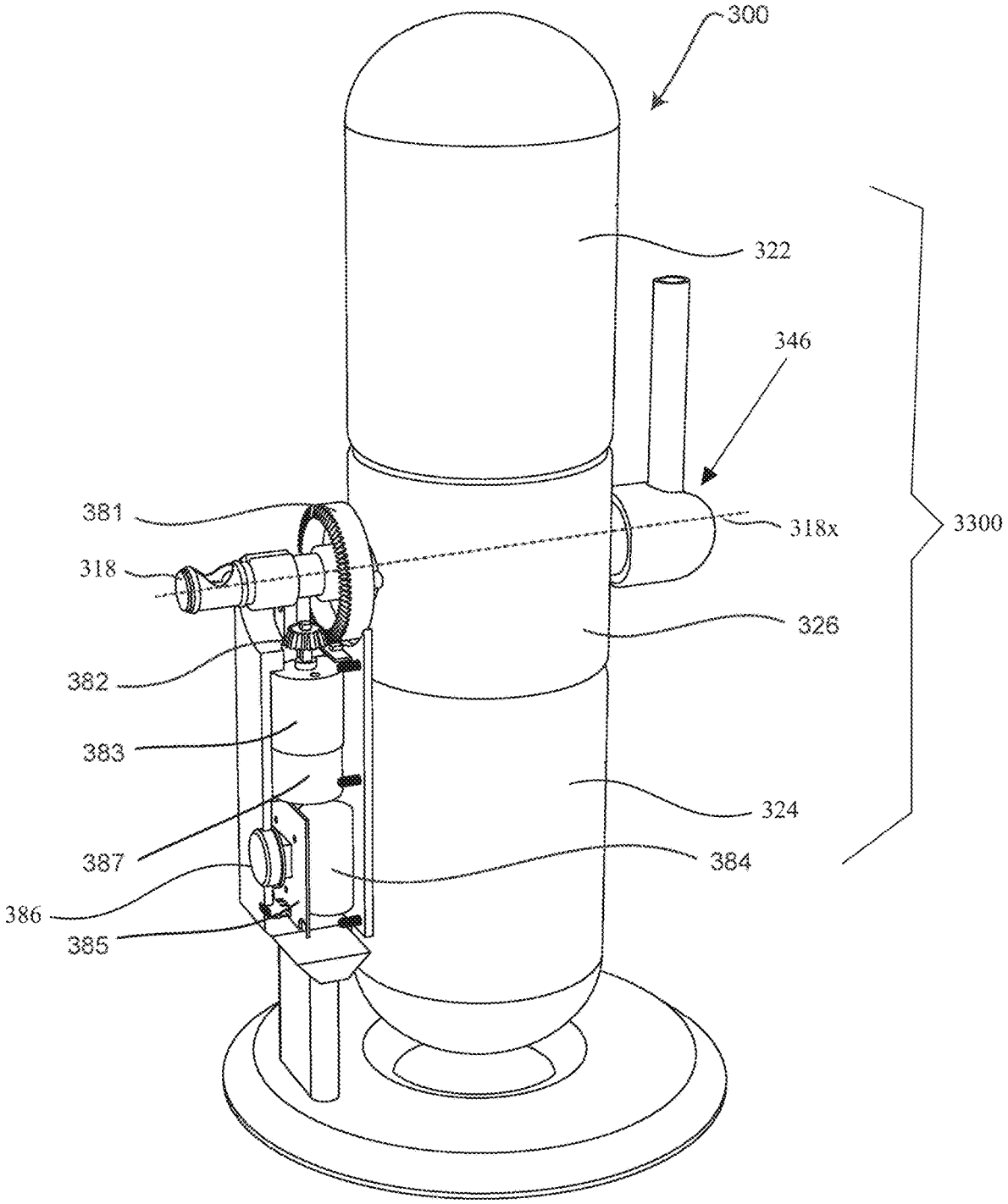
FIG. 6B illustrates a rotatable water filtration assembly in accordance with a third embodiment of the invention.

Referring to FIG. 6B, in use of the rotatable water filtration assembly 300 in accordance with a third embodiment of the invention is shown. The rotatable water filtration assembly 300 may comprise a first chamber 322, a second chamber 324, a mouthpiece assembly 346, a chamber coupling member 326, a battery 384, control circuit assembly 385, with a tactile or capacitive switch 386, A rotary positioning encoder 387, a gearhead electric motor 383, a second gear 382, a fixed shaft member 318, and a first gear 381. A rotatable water filtration assembly 3300 may be a combination of a first chamber 322, a second chamber 324, and a coupling member 326. A chamber coupling member 326 may be provided for being engaged with a first gear 381 and a second gear 382 may engaged with the first gear 381 and a gearhead electric motor 383 may be rotationally coupled with the second gear 382 for turning of the second gear 382 and thus rotating of the first gear 381 with the first gear 381 for rotating about the longitudinal axis of the fixed shaft member 318*x* and generally about the fixed shaft member 318 where gearhead electric motor may provide the external force. A battery 384 and control circuit assembly 385 with a tactile or capacitive switch 386 may be provided to controllably supply electrical power to the gearhead electric motor 383.

Capacitive sensors may be utilized to detect human touch of metal parts of the embodiment, such as the chamber coupling member 326, and one of brake the gearhead electric motor 383 and cause rotation of the gearhead electric motor 383. A rotary positioning encoder 387 may also be utilized in determining a rotational orientation of the chamber coupling member 326 about the fixed shaft member 318. The control circuit assembly 385 may comprise a wireless receiver for receiving of a wireless control signal from an external wireless device for initiating a rotation of the gearhead electric motor 383.

The first gear and the second gear, 381 and 382, may be bevel gears and may facilitate rotation by hand of the chamber coupling member 326. A magnetic or other clutch mechanism or a friction clutch mechanism may also be utilized to engage and disengage of the gearhead electric motor 383 to facilitate operating of the rotatable water filtration assembly 300 in accordance with the third embodiment of the invention by hand. In some embodiments, the clutch mechanism may be disengaged and the first chamber and second chamber may be rotated about the axis of the fixed shaft member 318*x* freely. An analog position sensor, such as a variable resistor or potentiometer or hall sensor may be provide to determine a rotational orientation of the first chamber and second chamber about the axis of the fixed shaft member 318*x*. In some embodiments, the clutch may be disengaged and the first chamber and second chamber rotated about the axis of the fixed shaft member 318*x* by hand. In some embodiments, the clutch may be engaged and the first chamber and second chamber rotated about the axis of the fixed shaft member 318*x* by motor. In some embodiments, the clutch may be a friction clutch that facilitates turning of the first chamber and second chamber rotated about the axis of the fixed shaft member 318*x* by hand and also for rotating of the first chamber and second chamber rotated about the axis of the fixed shaft member 318*x* by the motor and furthermore in some embodiments the friction clutch may facilitate the first chamber and second chamber stopping rotation about the axis of the fixed shaft member 318*x* in case an external factor affects the rotation, such as a hand or object interrupting the rotation of the first chamber and second chamber rotating about the axis of the fixed shaft member 318*x*.

Furthermore, a plurality of controllable color LED lights may be utilized to illuminate at least a portion of the first and second chambers in accordance with embodiments of the invention. The plurality of controllable color LED lights may be formed as part of a puck assembly that may be inserted into at least one of the first chamber and second chamber and may contain a battery and a wireless receiver circuit for wirelessly receiving of control signal data from the control circuit assembly 385 for controlling of a color of the controllable color LED lights. Furthermore, the puck assembly may contain a wireless charger and a battery unit and electrically coupled with the wireless receiver circuit. In some embodiments, a puck assembly may be waterproof and include at least a transparent or translucent window for facilitating of shining through of the LED lights past a housing of the puck assembly.

Advantageously, the embodiments of the invention provide for a gravity shisha or gravity water pipe or gravity operated water filtration apparatus that provides for percolating or water filtering features to cool the aerosol as well as to water filter the aerosol through percolation, as achieve in accordance with the embodiments of the invention as are described herein.

The terms "upper," "lower," "forward," "rearward," etc., have been used herein merely for the convenience of the foregoing specification and in the appended claims to described the water filtration apparatus water filtration apparatus and its parts as oriented in the drawings. It is to be understood, however, that these terms are in no way limiting to the invention since the water filtration apparatus water filtration apparatus may obviously be disposed in many different positions when in actual use.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A rotatable water filtration apparatus comprising:

a downstem assembly;

a fixed shaft member having a shaft member proximal end fluidly coupled with said downstem assembly and a distal end fluidly coupled with a mouthpiece assembly, such that air may enter the downstem assembly and move through and into the fixed shaft member and into a shaft member first fluid pathway from the shaft member proximal end and into a shaft member second fluid pathway and out from the distal end, wherein the shaft member first fluid pathway and the shaft member second fluid pathway are other than fluidly coupled together within the fixed shaft member;

a rotatable water filtration assembly configured to rotate about said fixed shaft member for pulling air through the downstem assembly into the shaft member first fluid pathway and for pushing air into the distal end of the fixed shaft member through the shaft member second fluid pathway in response to the rotation of said water filtration assembly being rotated about the fixed shaft member, wherein the rotatable water filtration assembly comprises:

a first chamber comprising a first coupling area and an outer end of the first chamber and for containing a volume of liquid;

a second chamber comprising a second coupling area and an outer end of the second chamber and for containing the volume of liquid, a chamber coupling member disposed approximately midway between the first chamber and the second chamber;

the chamber coupling member comprising an outer surface and, a first floor facing the first chamber and the first coupling area coupled with the chamber coupling member;

a second floor spaced apart from the first floor and facing the second chamber and the second coupling area coupled with the chamber coupling member;

a first inner conduit extending from the first floor into the first chamber towards the outer end of the first chamber and a first outer conduit extending back towards the first floor and terminating at a first outlet port comprises a first reversing air path and where the first outlet port is spaced away from the first floor towards the outer end of the first chamber, wherein the first inner conduit and the first outer conduit are coaxial;

a second inner conduit extending from the second floor into the second chamber towards the outer end of the second chamber and a second outer conduit extending back towards the second floor and terminating at a second outlet port comprises a second reversing air path and where the second outlet port is spaced away from the second floor towards the outer end of the second chamber wherein the second outer and second inner conduits are coaxial;

a proximal bore and a distal bore formed within the outer surface and penetrating through the chamber coupling member, both proximal and distal bores for receiving the fixed shaft member therein, the fixed shaft member proximal end extending proximally past the outer surface and the fixed shaft member distal end extending distally past the outer surface, wherein the proximal and distal bores are cylindrical and the fixed shaft member is cylindrical for the chamber coupling member to rotate about the fixed shaft member;

a drain passage disposed within the chamber coupling member between the first chamber and second chamber configured to allow liquid to drain therethrough under an influence of gravity;

a first sealing member;

a second sealing member;

wherein said first sealing member is configured to be fixed in place within the chamber coupling member;

wherein said second sealing member is configured to be fixed in place within the chamber coupling member;

wherein said first sealing members seals between said fixed shaft member, the proximal bore, and the distal bore;

wherein said second sealing members seals between said fixed shaft member, the proximal bore, and the distal bore;

wherein the first and second sealing members, rotate about the fixed shaft member in conjunction with the chamber coupling member;

filling a volume of liquid into one of the first chamber and second chamber that are other than in the top elevated position;

wherein the rotatable water filtration assembly is configured to have the chamber coupling member, the first and second chambers, the first conduit, the second conduit and the drain passage rotate to about the fixed shaft member, wherein rotating said rotatable water filtration assembly elevates the volume of liquid of the first chamber or second chamber, wherein said elevated volume of liquid drains from an elevated first chamber to a not elevated second chamber, or an elevated second chamber to a not elevated first chamber, through the drain passage due to gravity, wherein the draining of the liquid from said elevated first chamber to said not elevated second chamber, or said elevated second chamber to said not elevated first chamber, creates a vacuum in the upper portion of the elevated first chamber or elevated second chamber inducing air to flow from the downstem assembly through the shaft member first fluid pathway and into the first conduit of the elevated first chamber and out from the first outlet port along the first reversing airpath or the second conduit of the elevated second chamber and out from the second outlet port of the second reversing airpath, and the air flow to percolate upwardly through the volume of liquid downwardly draining through the drain passage the percolated air to gather into an upper area of the one of the elevated first chamber or elevated second chamber, wherein the drained volume of liquid forces air disposed in the not elevated first chamber or not elevated second chamber through an exhaust opening port fluidly connected to the shaft member second fluid pathway, rotation of the rotatable water filtration assembly configures the rotatable water filtration assembly to have the gathered percolated air to be in the not elevated first chamber or not elevated second chamber, as water drains into the not elevated first chamber or not elevated second chamber air is exhausted through the shaft member second fluid pathway; and a stand assembly comprising:

a stand collar for supporting the fixed shaft member;

a stand arm having a first end coupled with the stand collar and a second end extending radially from the stand collar towards a base assembly transversely oriented with the stand arm; and the stand collar for supporting the fixed shaft member and for orienting of the fixed shaft member within the stand collar in at least one orientation, wherein said stand assembly is configured to support the fixed shaft member and the stand collar.

2. The rotatable water filtration apparatus according to claim 1:

wherein the filling a volume of liquid into one of the first chamber and second chamber that are other than in the top elevated position may be 60% to 80% of a capacity of the one of the first chamber and second chamber.

3. The rotatable water filtration apparatus according to claim 1, wherein the rotatable water filtration assembly is configured to be rotated about the fixed shaft member in response to an external force being applied to said first chamber and the said second chamber and the chamber coupling member comprising a gearhead electric motor; wherein said gearhead electric motor is configured to apply the external force for rotating of the chamber coupling member about the fixed shaft member.

4. The rotatable water filtration apparatus according to claim 1 comprising: a first keyway and a second keyway that are within the stand collar, and wherein the first and second keyway are about ninety degrees circumferentially separated from each other about the fixed shaft member wherein the at least a keyway is for orienting of the fixed shaft member in relation to the stand assembly by about ninety degrees circumferentially and the fixed shaft member comprises a keyseat and a key disposed within one of the first keyway and a second keyway and the keyseat, the key for preventing rotation of the fixed shaft member in relation to the stand assembly and for orienting of the fixed shaft member within the stand collar in the at least one orientation.

5. The rotatable water filtration apparatus according to claim 1 wherein the downstem assembly comprises:

an aerosol generating system; wherein the aerosol generating system comprises a phyto material receiving area for receiving a phyto material through an access opening and for heating of the phyto material disposed proximate the downstem assembly for when heated to a predetermined temperature for generating at least some aerosol from the heating of the phyto material where the movement of the liquid from the top elevated position within the one of the first chamber and second chamber to the lower of the other of the first chamber and second chamber results in a suction area about a lower portion of the one of the first chamber and second chamber and this induces at least one of air and the least some aerosol to flow from the downstem assembly and through the shaft member first fluid pathway and results in the at least one of air and the at least some aerosol to percolate upwardly through the volume of liquid downwardly flowing through the drain passage and for the percolated at least one of air and the at least some aerosol to gather into an upper area of the one of the first chamber and second chamber, wherein the downward movement of the liquid forces the at least one of air and the at least some aerosol disposed in the other of the first chamber and second chamber, that was received therein during the previous revolution of the rotatable water filtration assembly, through an exhaust opening fluidly connected with the shaft member second fluid pathway, such that during each revolution of the rotatable water filtration assembly a volume of the at least one of air and the at least some aerosol is received within the one of the first chamber and second chamber and the previous volume of the at least one of air and the at least some aerosol received during the preceding revolution it exhausted from the other of the one of the first chamber and second chamber through the exhaust port fluidly connected to the shaft member second fluid pathway.

6. The rotatable water filtration apparatus according to claim 5 wherein the downstem assembly comprising the aerosol generating system comprises a heating element assembly for controllably receiving of electrical energy from an electrical energy storage source and for heating of the phyto material proximate the heating element assembly to the predetermined temperature for creating of the at least some aerosol, wherein the heating of the phyto material proximate the heating element assembly comprises one of:

wherein the phyto material comprises a phyto material extract, conductive heating of the phyto material extract disposed proximate the heating element assembly to the predetermined temperature for creating of the at least some aerosol where the predetermined temperature is between 500 and 700 degrees Fahrenheit and, wherein the phyto material comprises a phyto leaf material, conductive heating of the phyto leaf material disposed proximate the heating element assembly to the predetermined temperature for creating of the at least some aerosol where the predetermined temperature is between 350 and 450 degrees Fahrenheit and, wherein the phyto material comprises the phyto leaf material, convective heating of the phyto leaf material disposed proximate the heating element assembly to the predetermined temperature for creating of the at least some aerosol where the predetermined temperature is between 350 and 450 degrees Fahrenheit.

7. The rotatable water filtration apparatus according to claim 5 wherein the downstem assembly comprising the aerosol generating system comprises one of:

a heating element assembly for controllably receiving of electrical energy from an electrical energy storage source and for heating of the phyto material proximate the heating element assembly to the predetermined temperature for creating of the at least some aerosol;

wherein the phyto material comprises a phyto leaf material-leaf, the heating element assembly comprises at least one of conductive and convective heating of the phyto leaf material leaf disposed proximate the heating element assembly to the predetermined temperature for creating of the at least some combustion aerosol, and a bowl fluidly coupled with the downstem assembly, wherein the bowl is for receiving a-leaf the phyto leaf material for being heated to a combustion temperature for generating at least some combustion aerosol.

8. The rotatable water filtration apparatus according to claim 5 comprising: the stand collar for supporting the fixed shaft member where the downstem assembly is releasably coupled with the stand collar and the downstem assembly comprises the aerosol generating system comprises a heating element assembly for controllably receiving of electrical energy from an electrical energy storage source and for heating of the phyto material proximate the heating element assembly to the predetermined temperature for creating of the at least some aerosol and where the at least some aerosol is for propagating through the shaft member first fluid pathway.

9. The rotatable water filtration apparatus according to claim 1 comprising: the stand collar for supporting the fixed shaft member where the downstem assembly is releasably coupled with the stand collar and the downstem assembly comprises an external aerosol generating system for being fluidly coupled with the downstem assembly.

10. The rotatable water filtration apparatus according to claim 9 wherein the external aerosol generating system comprises a bowl fluidly coupled with the downstem assembly, wherein the bowl is for receiving a leaf phyto material for being heated to a combustion temperature for generating a combustion aerosol, wherein the least some aerosol comprises the combustion aerosol.

11. The rotatable water filtration apparatus of claim 1 wherein the chamber coupling member comprises: the drain passage disposed between the first chamber and second chamber forming an opening between the first floor and the second floor and propagating through the space between the floors.

12. A rotatable water filtration apparatus comprising:

a downstem assembly for holding a material to be combusted and for generating a combustion aerosol;

a fixed shaft member comprising a shaft member first fluid pathway fluidly coupled with the downstem assembly and a shaft member second fluid pathway coupled with an exhaust opening positioned about a lower side of the fixed shaft member, the second fluid pathway proximally formed at the exhaust opening and terminates at a shaft member output port fluidly coupled with a mouthpiece assembly;

a rotatable water filtration assembly rotatably mounted about said fixed shaft member and including a chamber coupling member, two chambers coupled with the chamber coupling member, a floor facing each of the chambers, the chamber coupling member and the floors of the chamber coupling member having a drain passage formed therein between the two chambers and wherein the rotatable water filtration assembly is normally oriented vertically with one chamber being disposed over the other chamber and wherein each chamber is for containing a volume of liquid that moves from one chamber to the other through the drain passage in response to rotating the rotatable water filtration assembly one-half turn;

each chamber comprising a respective inner conduit extending from the floor facing each of the chambers and into each chamber towards an outer end of each chamber and an outer conduit extending back towards the floor and terminating at an outlet port comprises a reversing air path and where the outlet port is spaced away from the floor wall towards the outer end of the chamber;

wherein each floor comprising a chamber coupling member exhaust port, wherein the inner and outer conduits are coaxial;

generating the combustion aerosol and directing combustion aerosol through the shaft member first fluid pathway and routing the combustion aerosol through an upper disposed chamber and percolating the combustion aerosol through the reversing air path and the through the liquid as the liquid moves from the upper oriented chamber to the lower oriented chamber after each half turn, the falling liquid creating a vacuum space above the falling liquid in the upper chamber that draws air through the material to be combusted and the combustion aerosol flowing and percolating through the reversing air path and the outlet port into the upper disposed chamber;

and the chamber coupling member exhaust port of the upper oriented chamber of the rotatable water filtration assembly for other than being fluidly coupled with the exhaust opening and the lower disposed chamber being fluidly coupled and aligned with the exhaust opening such that the falling liquid moving from the upper chamber to the lower chamber through the drain passage after each half turn forces the combustion aerosol to be exhausted from said chamber via exhaust opening and through the shaft member output port and fluidly coupled with the mouthpiece assembly.

13. A rotatable water filtration apparatus comprising:

a downstem assembly comprising an aerosol generating system for generating an aerosol;

a fixed shaft member comprising a shaft member first fluid pathway fluidly coupled with the downstem assembly and a shaft member second fluid pathway coupled with an exhaust opening positioned about a lower side of the fixed shaft member, the second fluid pathway proximally formed at the exhaust opening and terminates at a shaft member output port fluidly coupled with a mouthpiece assembly;

a rotatable water filtration assembly rotatably mounted about the fixed shaft member the rotatable water filtration assembly comprising a chamber coupling member disposed approximately midway between a first chamber as an upper chamber and a second chamber as a lower chamber, the chamber coupling member comprising a first floor facing the first chamber and a second floor spaced apart from the first floor and facing the second chamber, a drain passage disposed between the first chamber and second chamber for allowing of liquid to drain therethrough under an influence of gravity, wherein each floor comprising a chamber coupling member exhaust opening;

having a drain passage formed therein;

the chamber coupling member exhaust port of the lower chamber of said rotatable water filtration assembly for being fluidly coupled with the exhaust opening for maintaining the lower chamber open to exhaust opening such that an elevated volume of liquid draining from the upper chamber to the lower chamber after each half turn forces the generated aerosol contained in the lower chamber to be exhausted from the lower chamber via exhaust opening of the rotatable water filtration assembly;

wherein the rotatable water filtration assembly is normally oriented vertically with the upper chamber being disposed over the lower chamber;

wherein said rotatable water filtration assembly is configured to elevate a volume of liquid from the lower chamber to the upper chamber;

wherein said elevated liquid drains through said drain passage to the lower chamber;

wherein each chamber comprising a respective inner conduit extending from the floor into each chamber towards an outer end of the chamber and an outer conduit extending back towards the floor and terminating at an outlet port comprises a reversing air path and where the outlet port is spaced away from the floor towards the outer end of the respective chamber and wherein the inner and outer conduits are coaxial, wherein said aerosol generating system is configured to direct the generated aerosol through said fixed shaft member; said generated aerosol is routed through a respective conduit to the upper disposed chamber through the reversing air path and percolating the aerosol through the outlet port and through the liquid as the liquid within said chamber moves from the upper oriented chamber to the lower oriented chamber after each half turn, elevated liquid draining through the drain passage creates a vacuum space in said upper oriented chamber that draws air through the aerosol generating system and the aerosol flowing and percolating into the upper disposed chamber through the reversing air path and the outlet port; and wherein the chamber coupling member, upper and lower chamber, each reversing airpath, drain passage is for being rotated about the fixed shaft member in response to an external force being applied to at least one of the f-r-A upper chamber and the lower chamber;

wherein the downstem assembly comprising the aerosol generating system for generating the aerosol comprises a heating element assembly;

wherein said heating element assembly is configured to receive electrical energy from an electrical energy storage source; said heating element assembly is configured to heat the phyto material proximate to the heating element assembly to a predetermined temperature; and wherein the heating of the phyto material proximate to the heating element assembly comprises a conductive heating system for heating of the phyto material to the predetermined temperature.

14. The rotatable water filtration apparatus according to claim 12, wherein the rotatable water filtration assembly comprises the one chamber being disposed over the other chamber, the chamber coupling member disposed approximately midway between the one chamber being disposed over the other chamber, wherein the upper chamber being disposed over the lower other chamber comprises one of:

a first chamber comprising a first coupling area and an outer end of the first chamber and for containing a volume of liquid;

the chamber coupling member comprising a first floor facing the first chamber and the first coupling area coupled with the chamber coupling member;

a first conduit extending from the first floor into the first chamber towards the outer end of the first chamber and back towards the first floor and terminating at a first outlet port comprises a first reversing air path and where the first outlet port is spaced away from the first floor towards the outer end of the first chamber;

and a second chamber comprising a second coupling area and an outer end of the second chamber and for containing the volume of liquid;

the chamber coupling member comprising a second floor facing the second chamber and the second coupling area coupled with the chamber coupling member;

a second conduit extending from the second floor into the second chamber towards the outer end of the second chamber and back towards the second floor and terminating at a second outlet port comprises a second reversing air path and where the second outlet port is spaced away from the second floor towards the outer end of the second chamber;

and the other chamber comprises the other of:

the first chamber comprising the first coupling area and the outer end of the first chamber for containing the volume of;

the chamber coupling member comprising the first floor facing the first chamber and the first coupling area coupled with the chamber coupling member;

the first conduit extending from the first floor into the first chamber towards the outer end of the first chamber and back towards the first floor and terminating at the first outlet port comprises the first reversing air path and where the first outlet port is spaced away from the first floor towards the outer end of the first chamber;

the second chamber comprising the second coupling area and the outer end of the second chamber and for containing the volume of liquid;

the chamber coupling member comprising the second floor facing the second chamber and the second coupling area coupled with the chamber coupling member;

the second conduit extending from the second floor into the second chamber towards the outer end of the second chamber and back towards the second floor and terminating at the second outlet port comprises the second reversing air path and where the second outlet port is spaced away from the second floor towards the outer end of the second chamber;

a first inner conduit extending from the first floor into the first chamber towards the outer end of the first chamber and a first outer conduit extending back towards the first floor and terminating at a first outlet port comprises a first reversing air path and where the first outlet port is spaced away from the first floor towards the outer end of the first chamber, wherein the first inner conduit and the first outer conduit and first inner conduits are coaxial;

a second inner conduit extending from the second floor into the second chamber towards the outer end of the second chamber and a second outer conduit extending back towards the second floor and terminating at a second outlet port comprises a second reversing air path and where the second outlet port is spaced away from the second floor towards the outer end of the second chamber wherein the second outer and second inner conduits are coaxial.

15. The rotatable water filtration apparatus according to claim 13, wherein the rotatable water filtration assembly comprises the upper chamber being disposed over the lower chamber, the chamber coupling member disposed approximately midway between the upper chamber and the lower chamber;

wherein the upper chamber comprises one of:

a first chamber comprising a first coupling area and an outer end of the first chamber and for containing a volume of liquid;

the chamber coupling member comprising a first floor facing the first chamber and the first coupling area coupled with the chamber coupling member;

a first conduit extending from the first floor into the first chamber towards the outer end of the first chamber and back towards the first floor and terminating at a first outlet port comprises a first reversing air path and where the first outlet port is spaced away from the first floor towards the outer end of the first chamber;

a second chamber comprising a second coupling area and an outer end of the second chamber and for containing the volume of liquid;

the chamber coupling member comprising a second floor facing the second chamber and the second coupling area coupled with the chamber coupling member;

a second conduit extending from the second floor into the second chamber towards the outer end of the second chamber and back towards the second floor and terminating at a second outlet port comprises a second reversing air path and where the second outlet port is spaced away from the second floor towards the outer end of the second chamber;

the lower chamber comprises the other of:

the first chamber comprising the first coupling area and the outer end of the first chamber and for containing the volume of;

the chamber coupling member comprising the first floor facing the first chamber and the first coupling area coupled with the chamber coupling member;

the first conduit extending from the first floor into the first chamber towards the outer end of the first chamber and back towards the first floor and terminating at the first outlet port comprises the first reversing air path and where the first outlet port is spaced away from the first floor towards the outer end of the first chamber;

and the second chamber comprising the second coupling area and the outer end of the second chamber and for containing the volume of liquid;

the chamber coupling member comprising the second floor facing the second chamber and the second coupling area coupled with the chamber coupling member;

the second conduit extending from the second floor into the second chamber towards the outer end of the second chamber and back towards the second floor and terminating at the second outlet port comprises the second reversing air path and where the second outlet port is spaced away from the second floor towards the outer end of the second chamber.

* * * * *